US009427625B2

(12) United States Patent
Rose et al.

(10) Patent No.: US 9,427,625 B2
(45) Date of Patent: Aug. 30, 2016

(54) AIRBAG RESCUE SYSTEM AND TRIGGERING DEVICE THEREFOR

(71) Applicant: AMER SPORTS CANADA INC., North Vancouver (CA)

(72) Inventors: Gordon Rose, Bowen Island (CA); Gary Bryant, West Vancouver (CA)

(73) Assignee: AMER SPORTS CANADA INC., North Vancouver, British Columbia (CA)

( * ) Notice: Subject to any disclaimer, the term of this patent is extended or adjusted under 35 U.S.C. 154(b) by 0 days.

(21) Appl. No.: 14/802,475

(22) Filed: Jul. 17, 2015

(65) Prior Publication Data

US 2016/0016045 A1 Jan. 21, 2016

Related U.S. Application Data

(60) Provisional application No. 62/026,251, filed on Jul. 18, 2014.

(51) Int. Cl.

| | |
|---|---|
| ***B63C 9/08*** | (2006.01) |
| ***A63B 29/02*** | (2006.01) |
| ***A62B 33/00*** | (2006.01) |
| ***B63C 9/15*** | (2006.01) |

(52) U.S. Cl.
CPC ..... *A63B 29/021* (2013.01); *A62B 33/00* (2013.01); *B63C 9/155* (2013.01)

(58) Field of Classification Search
CPC ..... B63C 9/00; B63C 9/11; B63C 9/125; B63C 9/18; B63C 9/155; B63C 2009/00; B63C 2009/0023; B63C 2009/0029; B63C 2009/007; B63C 2009/0076; B63C 2009/0082; A63B 29/021; A63B 33/00
USPC ..... 441/80, 88, 89, 90, 92, 106, 114
See application file for complete search history.

(56) References Cited

U.S. PATENT DOCUMENTS

| | | | |
|---|---|---|---|
| 4,635,754 | A | 1/1987 | Aschauer et al. |
| 5,750,221 | A | 5/1998 | Scheckenbach et al. |
| 6,158,380 | A | 12/2000 | Aschauer et al. |

(Continued)

FOREIGN PATENT DOCUMENTS

| | | | |
|---|---|---|---|
| DE | 1 906 635 | A | 8/1970 |
| DE | 40 35 231 | A1 | 5/1992 |

(Continued)

*Primary Examiner* — Daniel V Venne

(74) *Attorney, Agent, or Firm* — Greenblum & Bernstein, P.L.C.

(57) ABSTRACT

An airbag rescue system employed as a life-saving system to enable a person to survive an avalanche or other situation, such as a water rescue. The airbag system includes an air movement device that takes the form of a source of compressed air or an electrically powered air mover, such as one that includes a bladed rotor for inflating the airbag with ambient air, such as 100% ambient air, for example. The system further includes a supporting device, such as a harness or a backpack, for supporting the inflatable airbag and the powered air movement device on a user in a ready position of the airbag rescue system. The system also includes triggering device that includes a trigger handle configured and arranged to initiate inflation of the inflatable airbag by being manipulated by the user. In the ready position of the airbag rescue system, while the airbag is not yet in a deployed position, the trigger handle is conveniently externally accessible for the user to trigger the inflation of the airbag.

19 Claims, 24 Drawing Sheets

(56) References Cited

U.S. PATENT DOCUMENTS

| | | | | |
|---|---|---|---|---|
| 6,270,386 | B1 | 8/2001 | Visocekas | |
| 6,298,487 | B1 | 10/2001 | Mayhew | |
| 6,646,204 | B2 | 11/2003 | Chaon et al. | |
| 7,055,656 | B2 | 6/2006 | Drew | |
| 7,270,077 | B2 | 9/2007 | Beck | |
| 7,370,370 | B2 | 5/2008 | Colombo | |
| 7,824,239 | B2 | 11/2010 | Weinel et al. | |
| 7,841,344 | B2 | 11/2010 | Schlosser | |
| 7,878,141 | B2 | 2/2011 | Paynton et al. | |
| 8,494,480 | B2 | 7/2013 | Aschauer et al. | |
| 8,777,684 | B2 | 7/2014 | Grutta et al. | |
| 8,851,948 | B2 | 10/2014 | Grutta et al. | |
| 8,851,949 | B2 | 10/2014 | Grutta et al. | |
| 8,876,568 | B2 | 11/2014 | Blenkarn et al. | |
| 9,004,116 | B2 | 4/2015 | Walker et al. | |
| 2003/0146348 | A1 | 8/2003 | Douglas et al. | |
| 2004/0244100 | A1* | 12/2004 | Haddacks | A62B 33/00 2/463 |
| 2008/0257643 | A1* | 10/2008 | Weinel | A62B 33/00 182/18 |
| 2009/0163095 | A1* | 6/2009 | Weinel | A62B 33/00 441/114 |
| 2009/0239428 | A1 | 9/2009 | Berchten | |
| 2010/0184343 | A1* | 7/2010 | Paynton | A62B 33/00 441/90 |
| 2012/0060267 | A1* | 3/2012 | Blenkarn | A45F 3/04 2/456 |
| 2013/0019994 | A1 | 1/2013 | Schaer et al. | |
| 2013/0146175 | A1 | 6/2013 | Walker et al. | |
| 2013/0149923 | A1 | 6/2013 | Walker et al. | |
| 2014/0213128 | A1 | 7/2014 | Hughes | |
| 2015/0228174 | A1* | 8/2015 | Bauer | H04W 4/02 340/539.13 |
| 2016/0016043 | A1* | 1/2016 | Rose | A45F 3/04 441/114 |
| 2016/0016144 | A1* | 1/2016 | Santilli | B01J 19/088 204/165 |

FOREIGN PATENT DOCUMENTS

| | | | |
|---|---|---|---|
| DE | 40 37 958 | A1 | 6/1992 |
| DE | 100 52 641 | A1 | 5/2000 |
| GB | 1 207 304 | A | 9/1970 |

* cited by examiner

FIG. 3
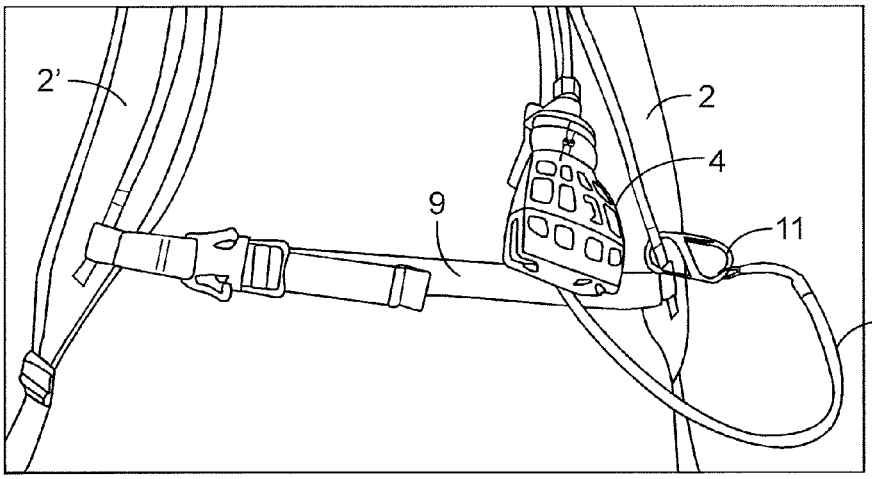
FIG. 4
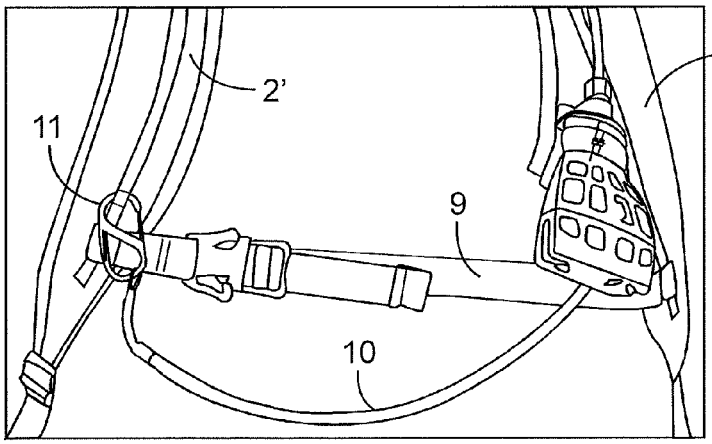
FIG. 5
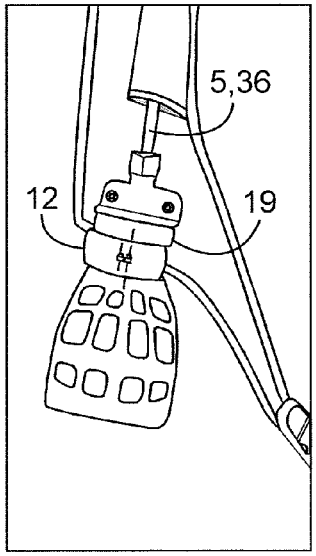
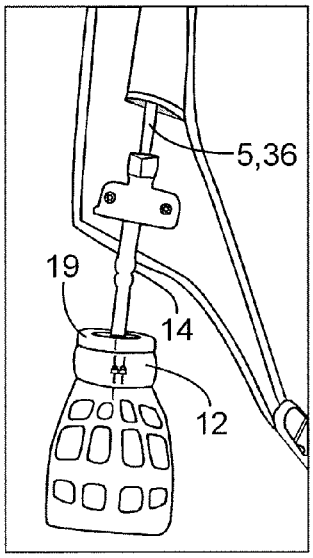
FIG. 6

FIG. 7
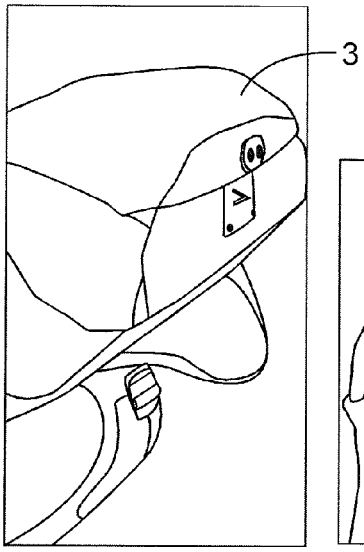
FIG. 8
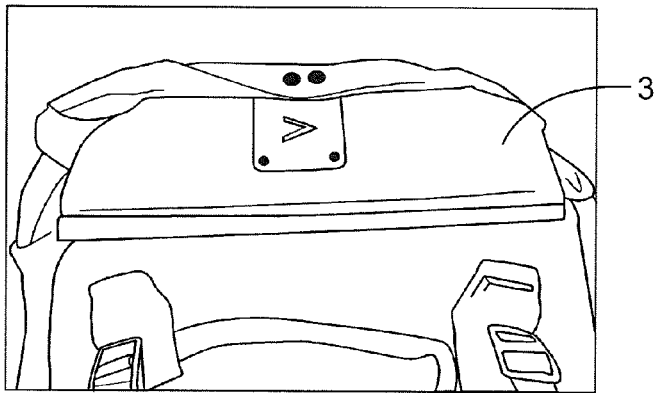
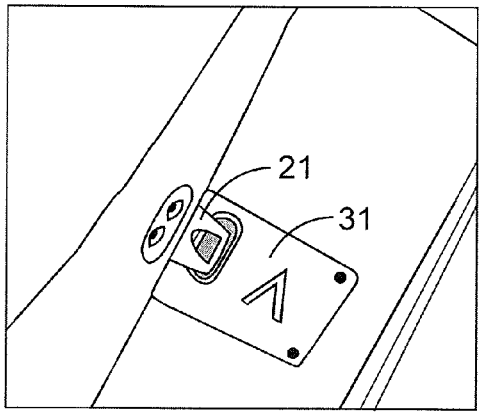
FIG. 9
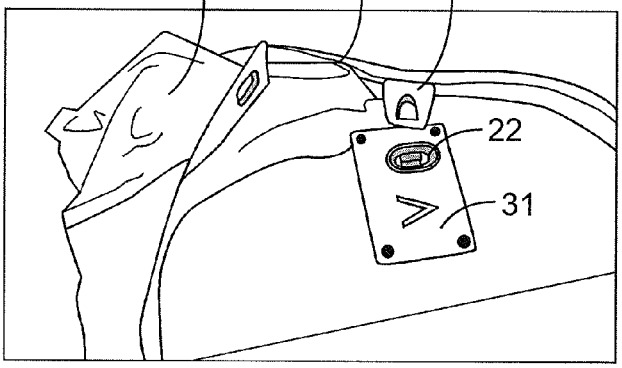
FIG. 10
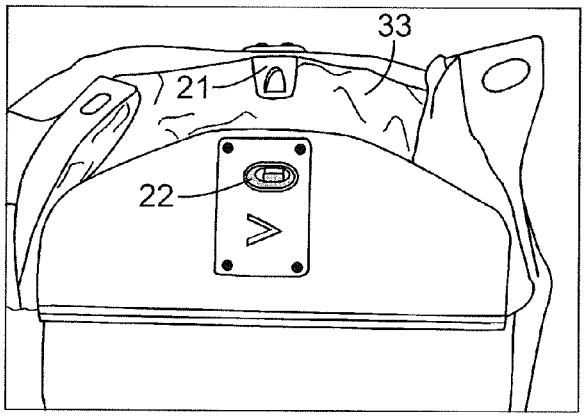
FIG. 11
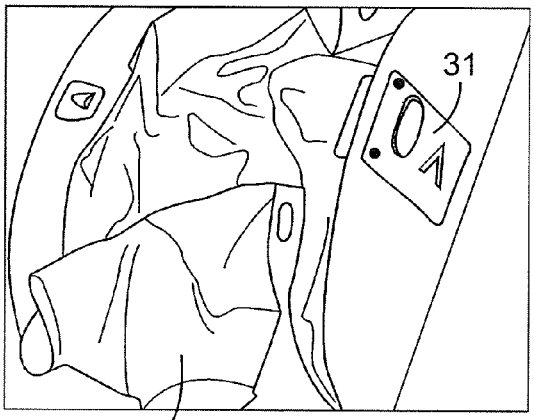
FIG. 12

AIRBAG RESCUE SYSTEM AND TRIGGERING DEVICE THEREFOR

CROSS-REFERENCE TO RELATED APPLICATION

This application claims the benefit under 35 U.S.C. §119 (e) of U.S. Provisional Patent Application No. 62/026,251, filed Jul. 18, 2014, the disclosure of which is hereby incorporated by reference thereto in its entirety.

BACKGROUND

The invention relates to an airbag system and, more particularly, to an airbag rescue or safety system and, more particularly, an airbag system employed as a life-saving system to enable a person using such system to survive an avalanche, or analogous situation, such as to facilitate a water rescue, e.g., as well as an airbag system for attachment to, and for recovering, equipment of the person, such as a snowmobile. In these regards, the invention relates to such systems disclosed in U.S. Pat. No. 8,876,568, the disclosure of which is hereby incorporated by reference thereto in its entirety. The system of US '568 employs a battery-powered electric motor to turn the blower, i.e., the fan, turbine, or impeller, e.g., to inflate the airbag. However, the invention also encompasses an airbag rescue or safety system that relies upon a compressed gas or air cartridge to inflate the airbag.

More particularly, the invention relates to a triggering device for an airbag rescue system.

A system of the aforementioned type can be used when activated (either remotely or manually by the user) to maintain the user or the user's equipment buoyant during an avalanche, or analogous situation, and to maintain the user or equipment on the surface of the avalanche, or as close to the surface as possible, thereby enabling the user to survive the avalanche or to facilitate recovery of the user's equipment.

In a further particular implementation, the field of invention relates to an airbag system utilized with a harness or backpack to be worn by a skier, snowboarder, snowmobiler, hiker, or a person engaged in another activity, who risks being exposed to an avalanche.

SUMMARY

The invention includes an airbag system and, particularly, an avalanche airbag system, and a triggering device therefor, whether such system is of the compressed air or gas cartridge type or another type, such as one that utilizes an electrically powered blower to inflate the airbag. More particularly, the invention relates to components of a triggering device for such an airbag system for initiating the inflation of the airbag, particularly while the airbag is supported on a person by means of a backpack or a harness.

An airbag rescue system encompassed by the invention includes:

- an inflatable airbag designed to be in a non-deployed position or a deployed and inflated position;
- an air movement device comprising at least one of the following: a source of compressed gas or air or an electrically powered air mover that includes a bladed rotor;
- a supporting apparatus comprising a harness or a backpack designed to support the inflatable airbag and the powered air movement device on the user in a ready position of the airbag rescue system;
- a base plate fixed to the supporting apparatus;
- a triggering device designed to be manipulated by the user according to at least first and second manipulations to initiate inflation of the inflatable airbag, the triggering device comprising:
  - a base fixed in relation to the base plate, the base including a blocking part;
  - a trigger handle designed for movement by the user, in relation to the base, from a non-airbag-inflation-initiation position to an airbag-inflation-initiation position;
  - a safety lock designed for movement by the user, in relation to the base, from a locked position and an unlocked position;
  - said movement of the safety lock comprising the first manipulation of the triggering device, and said movement of the trigger handle comprising the second manipulation of the triggering device; and
  - in the locked position of the safety lock, the safety lock engages the blocking part and blocks the movement of the trigger handle, and, in the unlocked position of the safety lock, the safety lock is not blocked by the blocking part of the base.

According to a particular embodiment, the supporting apparatus comprises a shoulder strap and the base plate is fixed in relation to the shoulder strap.

In one embodiment, the safety lock is mounted over the base and the movement of the safety lock is transverse in relation to the base.

In one embodiment, the safety lock is mounted over the base and the movement of the safety lock is rotational in relation to the base.

Further, according to the invention, the triggering device further comprises a cable extending between the trigger handle and the supporting apparatus.

According to another particular embodiment, the base has a tubular shape and extends from the base plate in a direction to the trigger handle, the trigger handle slidably mounted on the tubular base. Further, the cable of the triggering device is fixed in relation to the trigger handle and extends through the tubular base and the cable and a cable housing extend between the base plate and the supporting apparatus.

In a particular embodiment in which the air movement device is an electrically powered air mover, the invention further includes an electric power switch designed to activate the electrically powered air mover, and the cable is connected to the electric power switch.

A particular feature of the invention relates to the trigger handle being externally accessible and includes no pocket or cover so as to maintain the trigger handle in a ready position. More particularly, according to a particular embodiment, the trigger handle is suspended from the base plate.

In a particular embodiment of the invention, the supporting apparatus comprises a closeable airbag compartment containing the airbag in the non-deployed position, and the airbag compartment includes an opening system to allow the airbag to emerge from an opening in the compartment upon the initiation of the inflation of the airbag by the triggering device.

More particularly, the opening system can comprise a readily burstable slide fastener that releasably closes the opening of the airbag compartment and is designed to open upon inflation of the airbag. The aforementioned cable is operably connected to the air movement device to activate either the source of compress air or the electrically powered air mover upon initiation of the inflation of the airbag by the triggering device.

In another particular embodiment of the invention, the air movement device is an electrically powered air mover comprising a power switch, and the cable is operably connected to the power switch to activate the electrically powered air mover upon initiation of the inflation of the airbag by the triggering device.

As an alternative to a readily burstable slide fastener to releasably close the airbag compartment, the opening system can include a lid and a latch mechanism to releasably secure the lid over the opening. The latch mechanism comprises a latch fixed to one of a surface of the compartment or a surface of the lid and a post fixed to a second of the surface of the compartment or the surface of the lid, and whereby the cable is operably connected to the air movement device to activate either the source of compress air or the electrically powered air mover.

An airbag rescue system encompassed by the invention also includes:

- an inflatable airbag designed to be in a non-deployed position or a deployed and inflated position;
- an gas or air movement device comprising at least one of the following: a source of compressed gas or air or an electrically powered air mover that includes a bladed rotor;
- a supporting apparatus comprising a harness or a backpack designed to support the inflatable airbag and the air movement device on the user in a ready position of the airbag rescue system, the supporting apparatus comprising first and second shoulder straps;
- a base plate fixed in relation to the first shoulder strap;
- a triggering device designed to be manipulated by the user to initiate inflation of the inflatable airbag, the triggering device comprising:
  - a base fixed in relation to the base plate;
  - a trigger handle designed for movement by the user, in relation to the base, from a non-airbag-inflation-initiation position to an airbag-inflation-initiation position;
  - a supplemental triggering mechanism comprising a lanyard having a first end fixed in relation to the trigger handle and a second end having a releasable clip;
  - the lanyard having a length designed to allow the releasable clip to removably fasten the lanyard to a second location spaced apart from the trigger handle.

According to the invention as described above, the second location can be the second shoulder strap and the lanyard can extend between the first and second shoulder straps.

With further regard to the invention as described above, the base plate is removably fixed in relation to the first shoulder strap to allow relocating the base plate to be fixed in relation to the second shoulder strap.

An airbag rescue system encompassed by the invention also includes:

- an inflatable airbag designed to be in a non-deployed position or a deployed and inflated position;
- an air movement device comprising at least one of the following: a source of compressed gas or air or an electrically powered air mover that includes a bladed rotor;
- a supporting apparatus comprising a harness or a backpack designed to support the inflatable airbag and the air movement device on the user in a ready position of the airbag rescue system, the supporting apparatus comprising at least one shoulder strap;
- a base plate fixed in relation to the shoulder strap;
- a triggering device designed to be manipulated by the user to initiate inflation of the inflatable airbag, the triggering device comprising:
  - a base fixed in relation to the base plate and having a length extending from the base plate;
  - a trigger handle slidably mounted along the length of the base for movement by the user from a non-airbag-inflation-initiation position to an airbag-inflation-initiation position;
  - at least one detent, or detent recess fixed at a predetermined position along the length of the base to engage a portion of the trigger handle during the movement of the trigger handle but before the trigger handle reaches the airbag-inflation-initiation position to thereby provide physical feedback to the user of an impending triggering of the inflation of the airbag.

According to the invention as described above, the at least one detent or detent recess and the portion of the trigger handle are made of materials and are arranged in relation to each other to require a force between 50 and 150 Newtons to be applied to the trigger handle to move the portion of the trigger handle beyond the detent or detent recess to enable the trigger handle to the airbag-inflation-initiation position.

With further regard to the invention as described above, at least one of the detents or the portion of the trigger handle comprises an elastically deformable material.

With further regard to the invention as described above, there are two detents or detent recesses spaced apart from each other.

BRIEF DESCRIPTION OF THE DRAWINGS

Other features and advantages of the invention will be better understood from the following description, with reference to the annexed drawings illustrating, by way of non-limiting embodiments, how the invention can be implemented, and in which:

FIG. 3 is partial view of a pack of the invention employing a lanyard connected to a left shoulder strap with an end clipped thereto;

FIG. 4 is a partial view like that of FIG. 3, with the end of the lanyard clipped to the right shoulder strap to provide additional triggering options in the event access to the trigger handle itself were to be difficult during an avalanche situation;

FIG. 5 is a partial view of a shoulder strap to which the triggering device is affixed, showing the trigger handle in the non-airbag-inflation-initiation position;

FIG. 6 is a partial view like that of FIG. 5, showing the trigger handle in the airbag-inflation-initiation position and showing a recess/detent on the base of the triggering device that had engaged a portion of the trigger handle as it had been pulled longitudinally away from the base plate of the triggering device, the base plate being fixed to the shoulder strap;

FIG. 7 is a partial view of a pack according to an embodiment, showing a lid closed on a top opening of the airbag compartment of the pack;

FIG. 8 is a partial view of the pack according to FIG. 7 in a front view;

FIG. 9 is partial view of the pack of FIG. 7, showing the post (fixed to the lid) of a latch mechanism having been released from the latch (fixed to an upper portion of the pack);

FIG. 10 is a partial view of the pack of FIG. 9, showing the airbag beginning to emerge from its compartment of the pack;

FIG. 11 is a partial view of the pack of FIG. 10 in a front view;

FIG. 12 is a partial view of the pack of FIG. 11, showing the lid more widely open and the airbag further expanding from its compartment;

DETAILED DESCRIPTION

The following description makes reference to FIGS. 1-28C, which illustrate exemplary embodiments and features of the invention. The description and drawings are presented for the purpose of explanation and understanding, but the particular structures, details, and features that are shown and described are not intended to limit the invention unless otherwise expressed herein.

The invention encompasses a triggering device, such as for use in an avalanche rescue system, and, more particularly, in a system that employs a backpack or harness that carries an inflatable airbag. A triggering device according to the invention includes structural components designed to initiate the activation of the means used to inflate the airbag, such as an electric motor that turns a fan/turbine/impeller or that activates inflation via a compressed gas or air canister/cartridge/container.

Figure 1:
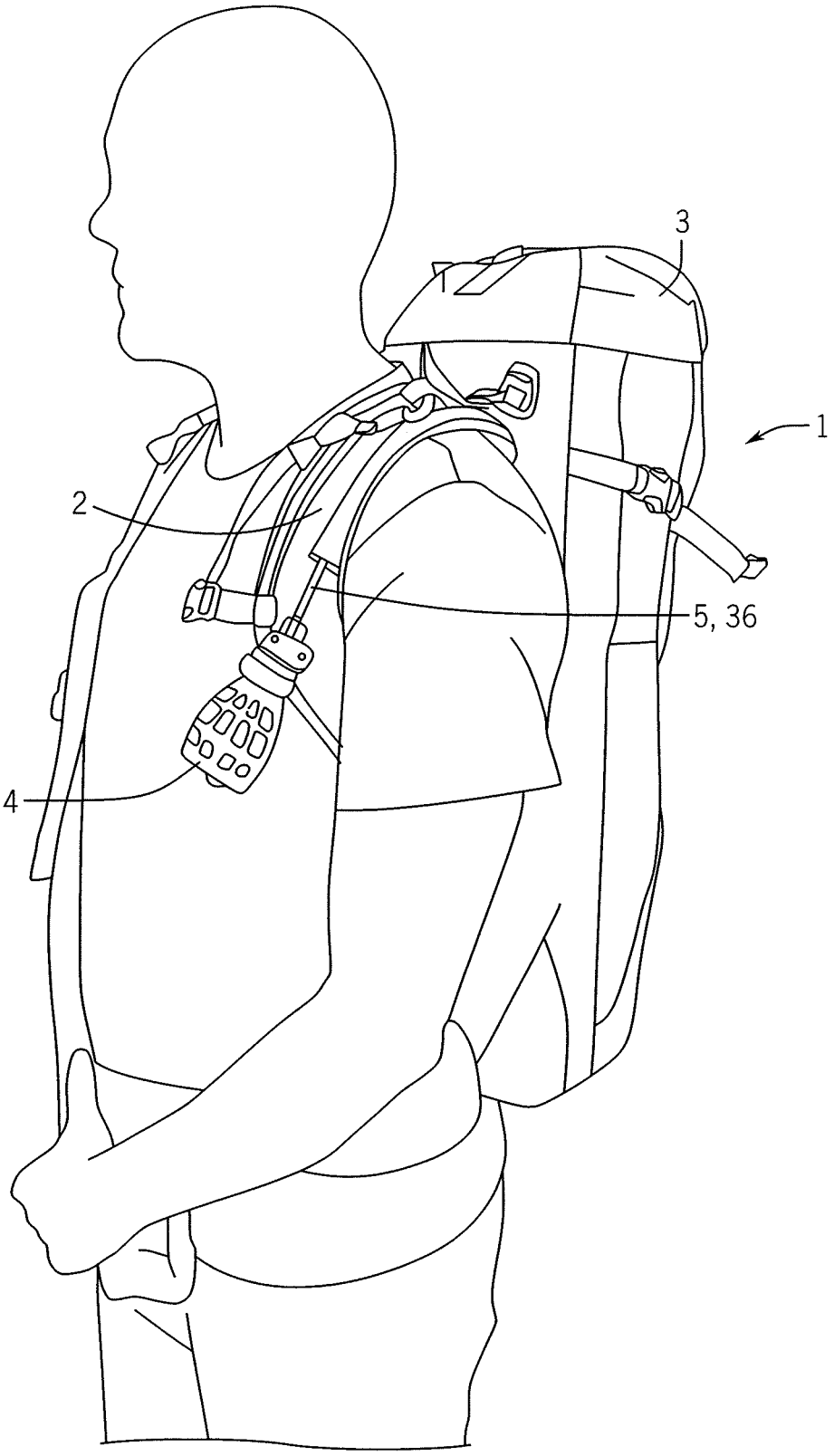
FIG. 1 is a perspective view of an airbag rescue system according to the invention in the form of a pack being worn by a user and in a ready position, the triggering device being positioned for activation.

FIG. 1 illustrates a pack 1 worn on the back of a user, the pack being supported by at least one shoulder strap 2, or a pair of shoulder straps 2, 2', one of which is shown in FIG. 1. In the embodiment shown in FIG. 1, the top of the pack includes a hinged lid 3, shown in a closed position beneath which an uninflated or underinflated airbag, or balloon, is housed within a compartment of the pack 1. The top of the pack can be designed differently, such that, for example, the pack is closed by means of a structural configuration that utilizes a mechanical latch or no latch. As described in greater detail below with reference to other drawing figures, once the user activates the triggering device, the latch is moved to a position that allows the stowed airbag to emerge from within the pack as it is inflated. As also described below, alternatively, an airbag compartment can be closed with a readily burstable slide fastener, such as a burst zipper, which opens from the force of the inflating airbag.

The trigger handle 4 of the triggering device 30, described in greater detail below and with reference to additional drawing figures (see FIG. 4, for example), is shown in FIG. 1 in the non-airbag-inflation-initiation position. According to the invention, the triggering handle 4 is designed to be easily accessible to the user, no pocket or cover designed to stow it away, but being difficult to trigger accidentally. A cable 5 or, more particularly, a cable in a housing 36, extends from the triggering handle 4 to an actuator that activates inflation of the airbag. This actuator can be coupled to a latch, as further described below.

For example, the trigger handle 4 is constantly available on, or just off, a shoulder strap and not, for example, in a closed pocket, perhaps zipped away. FIG. 1 shows the trigger handle 4 conveniently located at a generally mid-torso height, or slightly above the mid-torso, and at a left-of-center position on or proximate the left shoulder strap, the latter location being particularly convenient for grasping the handle with the right hand. For left-handed grasping of the trigger handle, the trigger handle is releasably fixed in placed so that it can be relocated on or proximate the right shoulder strap. As shown in FIG. 1, the trigger handle 4 is constantly available.

Figure 2:
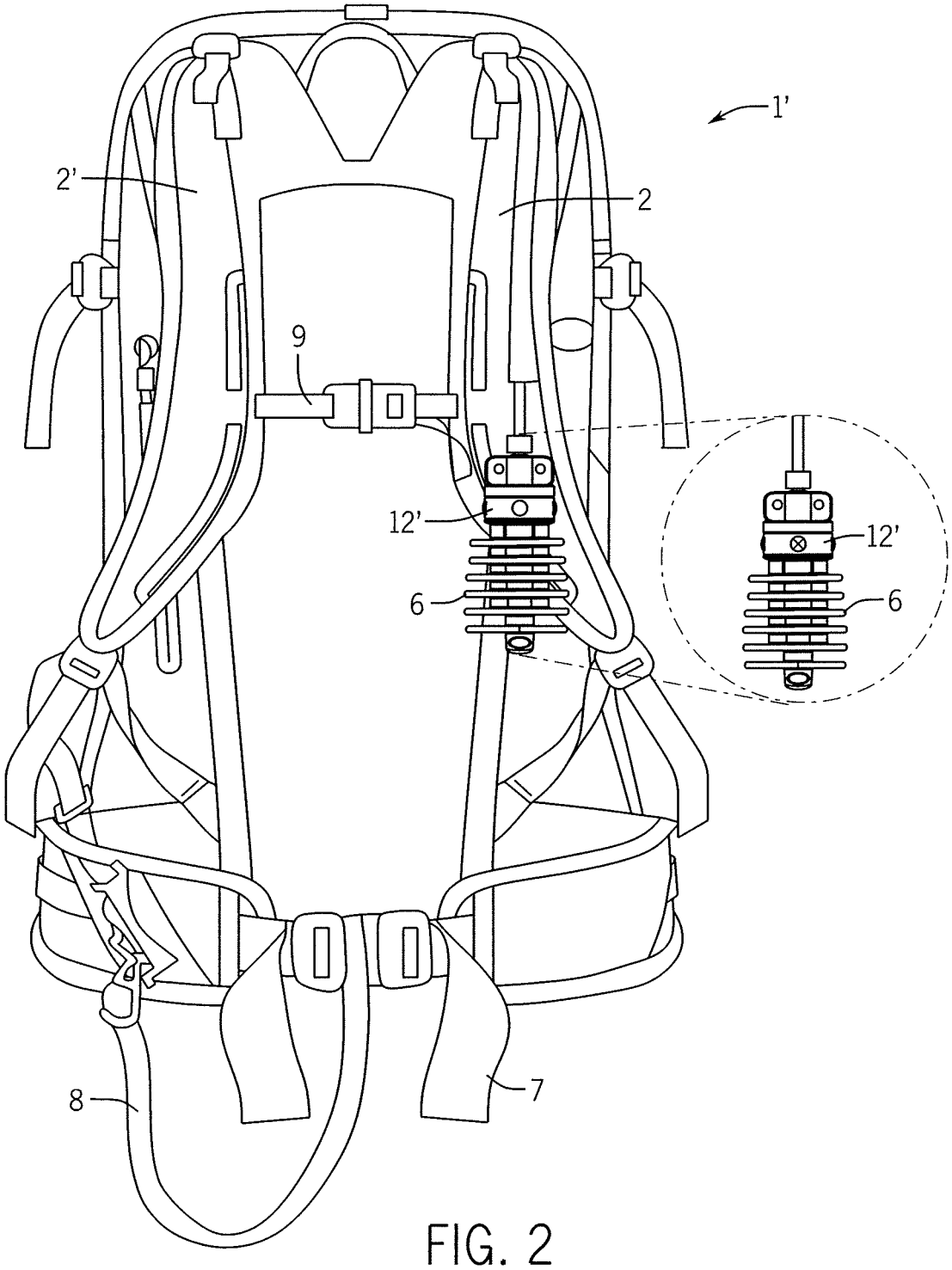
FIG. 2 is a front view of a pack according to the invention, having a different trigger handle from that of the rescue system pack of FIG. 1.

FIG. 2 is a front view of a pack 1' according to the invention, having a trigger handle 6 with a shape different from that of the trigger handle 4 of FIG. 1. The trigger handle 6 is shown in an unlocked position (indicated by a solid circle on the lock 12') and in a locked position (indicated by an "X" on the lock 12'). The pack of FIG. 2 shows an optional waist belt 7 for additional support on the wearer, as well as a leg strap 8, both of which can be employed in the pack of FIG. 1.

Figure 26:
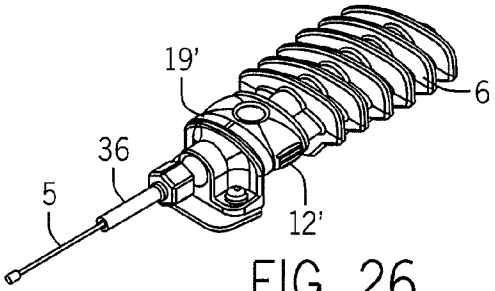
FIG. 26 is an exploded perspective view of the handle, base, cable, and rotatable safety lock components of the triggering device shown in FIG. 19.
Figure 26B:
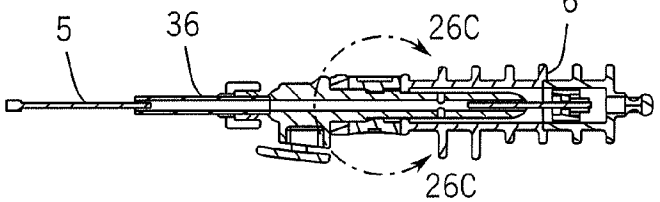
FIG. 26B is a longitudinal cross-sectional view taken along lines A-A of FIG. 26A.
Figure 26A:
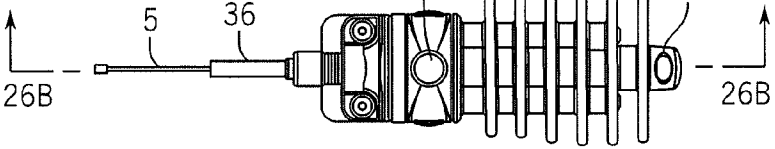
FIG. 26A is a top view of the components of FIG. 26, with the rotatable safety lock in the unlocked position.

In addition, sternum strap 9 extends between the left and right shoulder straps 2, 2'. An optional feature of the invention is a lanyard 10, in the form of a cross-chest cable, as shown in FIGS. 3 and 4, having one end fixed to the trigger handle 4, such as through a hole 25 (see FIG. 14A) or hole 25' (see FIG. 26A). In FIG. 3, the opposite end of the lanyard 10 is releasably clipped to the left shoulder strap 2, that is, the same shoulder strap to which the triggering device and trigger handle 4 is connected. In FIG. 4, the releasable clip 11 is released from the right shoulder strap 2 and is secured to the left shoulder strap 2'. When the lanyard 10 is positioned to extend as shown in FIG. 4, the user is provided with a supplemental triggering mechanism to provide additional triggering possibilities in the event access to the trigger handle 4 (or handle 6 of FIG. 2) were to be difficult in an avalanche situation. That is, in certain avalanche situations, when one is caught in an avalanche slide before the airbag can be triggered, it can become difficult or impossible to reach the trigger handle so as to pull and activate the airbag. In such a case, the wearer would have the option of swiping either hand downward along the torso between the shoulder straps and catch the lanyard 10 and pull it downward, thereby also pulling the trigger handle 4 or 6 downward to initiate airbag inflation. This supplemental triggering mechanism/lanyard thereby provides the possibility of accomplishing triggering of inflation of the airbag with a larger and less precise movement than grasping the trigger handle. Alternatively, the lanyard 10, when not connected across the user's chest, can also be allowed to hang below the trigger handle such that it can be caught with a simple swipe of the thumb. Such lanyard can be used with either blower or compressed air or gas systems. In fact, according to the invention, a lanyard can be attached to any trigger for any airbag rescue system generally. This would include airbag rescue systems other than those disclosed herein, including such systems with or without safety locks, for example. Further, the releasable clip 11 can be any of many types, such as snap hooks, detachable buckles, and others.

Figure 17:
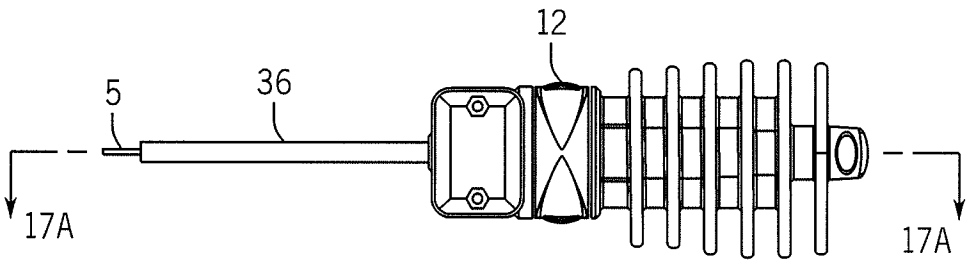
FIG. 17 is a top view of a trigger handle of the triggering device of an embodiment of the invention shown in FIG. 2, showing a slide lock thereof in an unlocked position, allowing the trigger handle to be pulled away from the base plate along the base of the triggering device.

Accidental triggering is prevented by virtue of certain precautionary measures. First, a trigger lock is incorporated into the trigger handle 4, 6. FIGS. 5 and 6 schematically illustrate two respective positions of a first embodiment of the lock, in the form of a slide trigger lock 12, retained in place by lock retainer 19 with fasteners 47. This first embodiment and a second embodiment of such a lock are further described below and are illustrated in other drawing figures. The slide trigger lock 12, similar to a gun safety, is easily moved by one's finger selectively between an engaged and locked position (shown in FIG. 5), and a disengaged and unlocked position (shown in FIG. 6), the trigger lock being secure and stable in each position. FIG. 18B also illustrates the trigger lock 12 in the locked (engaged) position, and FIG. 17B illustrates the trigger lock 12 in the unlocked (disengaged) position. These respective positions are visible to the user by virtue of the position of the slide trigger lock 12 in relation to the length of the remainder of the trigger handle 12. More specifically, when the slide lock 12 is in the unlocked position, the width of the lock 12 is centered, or substantially centered, in relation to the length of the handle 12, as shown in FIG. 17. When the slide lock 12 is in the locked position, the width of the lock 12 is offset in relation to the length of the handle 6, as shown in FIG. 18. Still further, the cross-sectional enlarged detail views of FIGS. 17B and 18B show different engagements of surfaces of the base 13 slide lock in the unlocked and locked positions, respectively. In the unlocked slide lock position of FIG. 17B, the lower profile wedge 52 of the inside of the lock 12 is positioned in the recess, that is, detent recess 14 of the base 13 only partially and, when the user pulls on the handle along the base, the engagement between the handle 12 and base 13 is overcome upon exertion of a sufficient longitudinal pulling force, whereby the cable is pulled and inflation of the bag is initiated. If, however, the slide lock 12 were to be moved in its offset, locked, position of FIG. 18, a wider profile wedge 53 comes into play, as shown in FIG. 18B, that has a shape that more fully engages the recess of the base, that is, the detent 14 of the base or, more specifically, the detent recess of the base. Herein, the expression "detent recess" is used to refer to a recess that is designed to be engaged with a detent or other wedge, projection, or surface. Such engagement effectively blocks, or at least effectively blocks, any effort by the user to pull the handle 12 longitudinally to an airbag-inflation-initiation position. The slide trigger lock 12 is also shown in the exploded diagrams of FIGS. 14, 14A, and 14B. The slide trigger lock 12, and a rotatable, or twistable, trigger lock 12', are further described below. The invention encompasses airbag systems generally, including ones that rely upon a compressed air or gas cartridge, that have a triggering device that requires a pulling of a handle for actuation, inasmuch as such pulling can be provided to be locked against movement or unlocked for movement.

A second measure to prevent accidental triggering is a requirement for a certain threshold force to be exerted for triggering the activation of the inflation of the airbag. For example, a pull force within a range of 50 N to 150 N, for example, can be set to release the airbag, i.e., a good firm pull. This range is in the proposed CE standard (such as in the February 2014 draft Norm prEN 16716 "Mountaineering equipment—Avalanche airbag systems—Safety requirements and test methods)." For example, a force of 100 N can be set.

Figure 14:
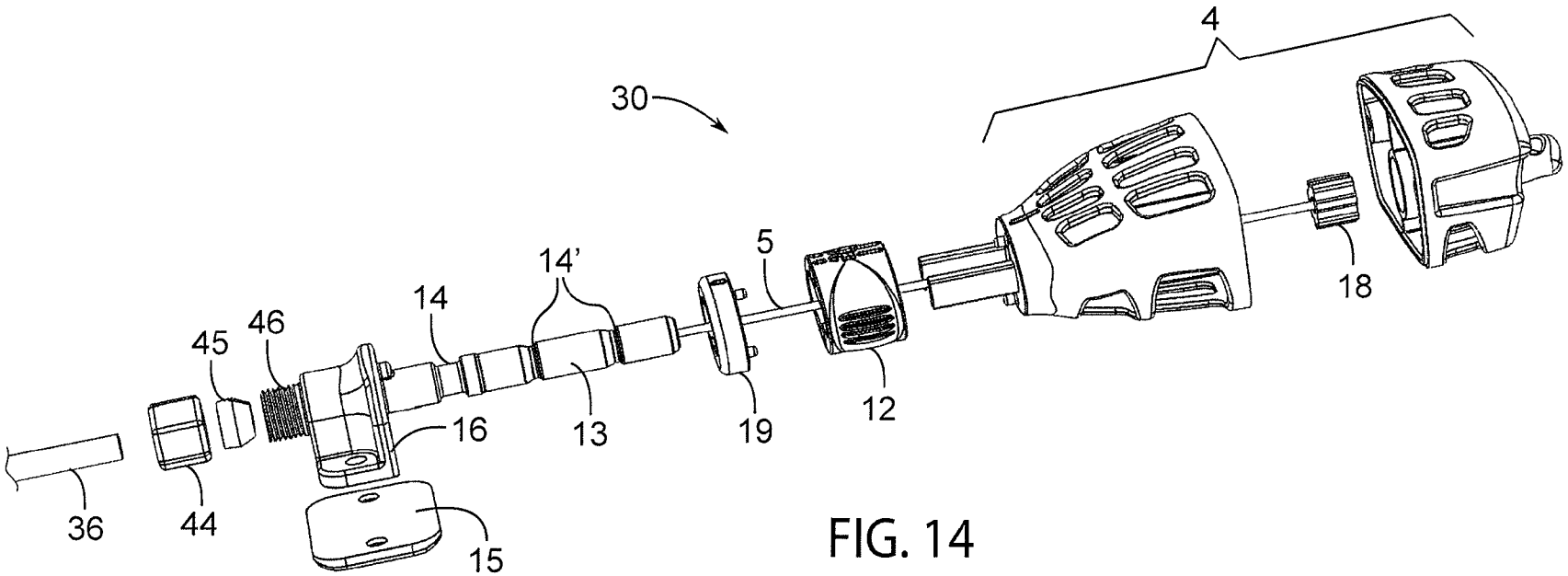
FIG. 14 is an exploded perspective view of a triggering device according to the invention, with the trigger handle of FIG. 1.
Figure 14A:
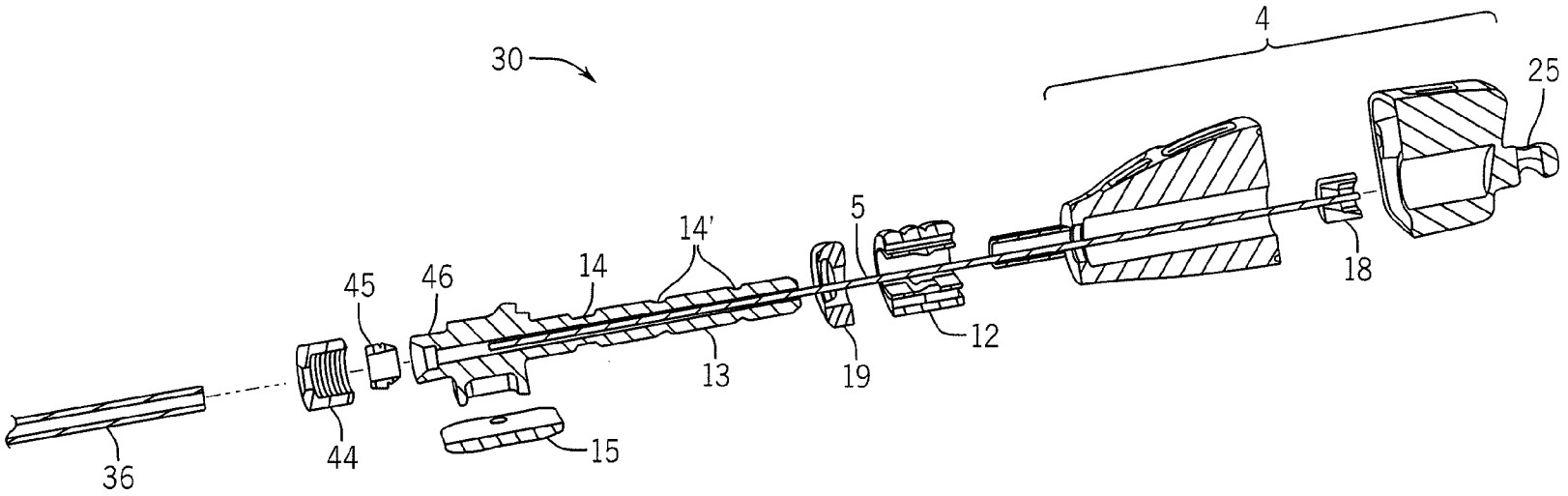
FIG. 14A is a cut-away side view of the triggering device of FIG. 14.
Figure 14B:
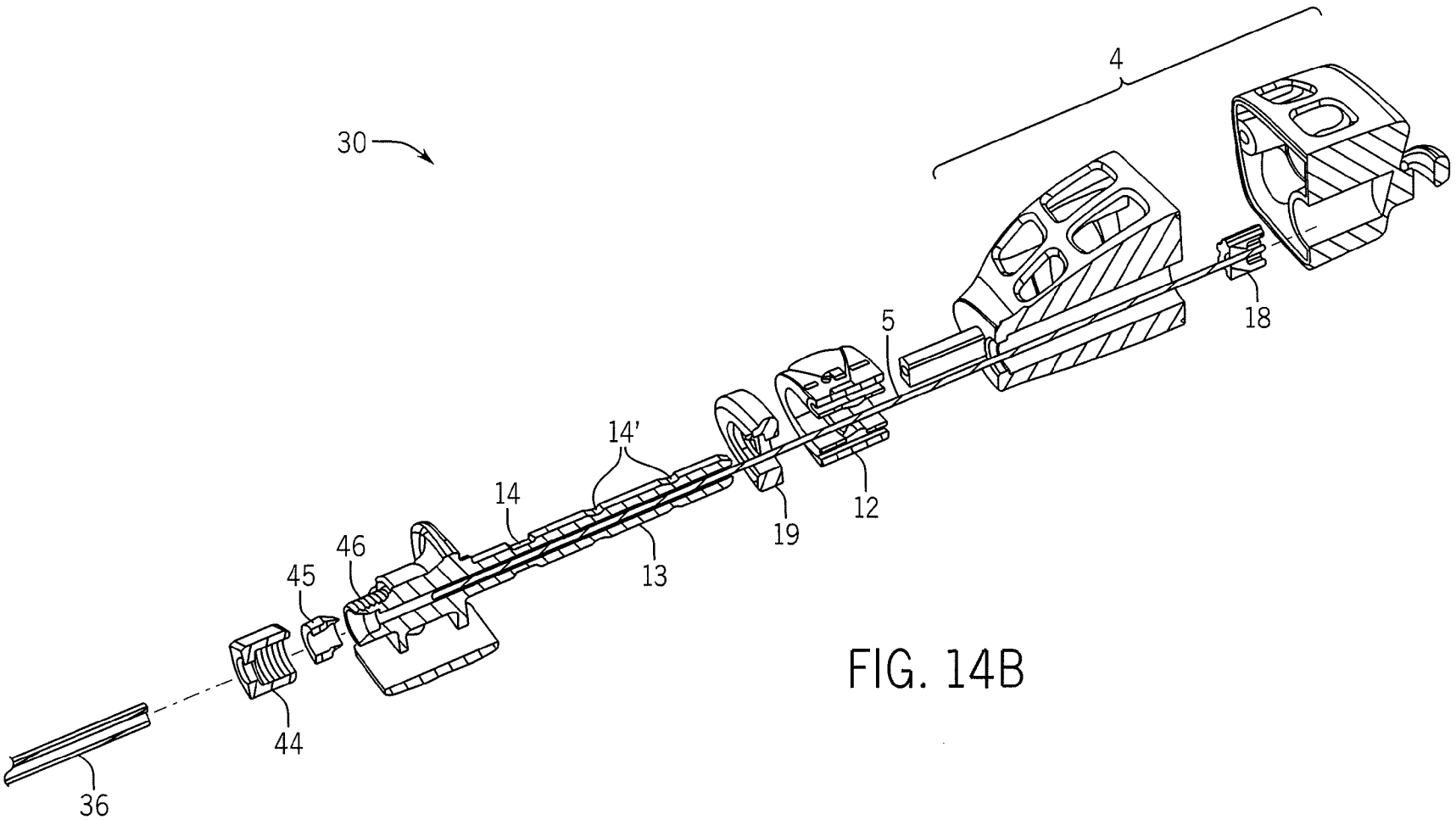
FIG. 14B is a perspective cut-away view of the triggering device of FIG. 14.

As shown in FIG. 6, as well as in FIGS. 14, 14A, and 14B, the trigger handle 4 is movable longitudinally in relation to the base 13 of the triggering device, the base 13 being fixed with respect to a base plate 15, the base plate being fixed in relation to the shoulder strap 2. The base 13 is raised from the surface of the shoulder strap and the interior of the trigger handle 4 slidably receives the longitudinally projecting base. The cable 5 extends from the pack through the base 13 and is fixed to the trigger handle 4 by means of a cable end stop 17 and a stopper 18. On the outer surface of the base 13 is at least one detent recess 14, although two additional detent recesses 14' are shown in the drawing, which detents become frictionally engaged with an inner surface of the trigger handle 4 when the handle is pulled in a direction to trigger airbag inflation. The detent recess(es) 14 and 14' and the interior of the handle 4 are structured and made of materials, such as one or more elastically deformable materials or shapes so as to require the aforementioned force of 50-150 N to be exerted by pulling on the trigger handle 4, by means of the interior of the handle 4 passing over the detent recess 14, the additional detent recesses 14' providing a lesser force, yet providing physical feedback to the user. The required force 50-150 N could be settable and/or designed differently, for instance, by using elastic means, a spring, rubber, or the like. The total pull travel of the trigger handle 4, 6 is approximately 45 to 50 mm in accordance with a non-limiting embodiment and beyond the frictional sliding of the handle over the detent recesses 14, 14', thereby providing an opportunity to stop pulling in the event of an unintentional triggering attempt.

Figure 19:
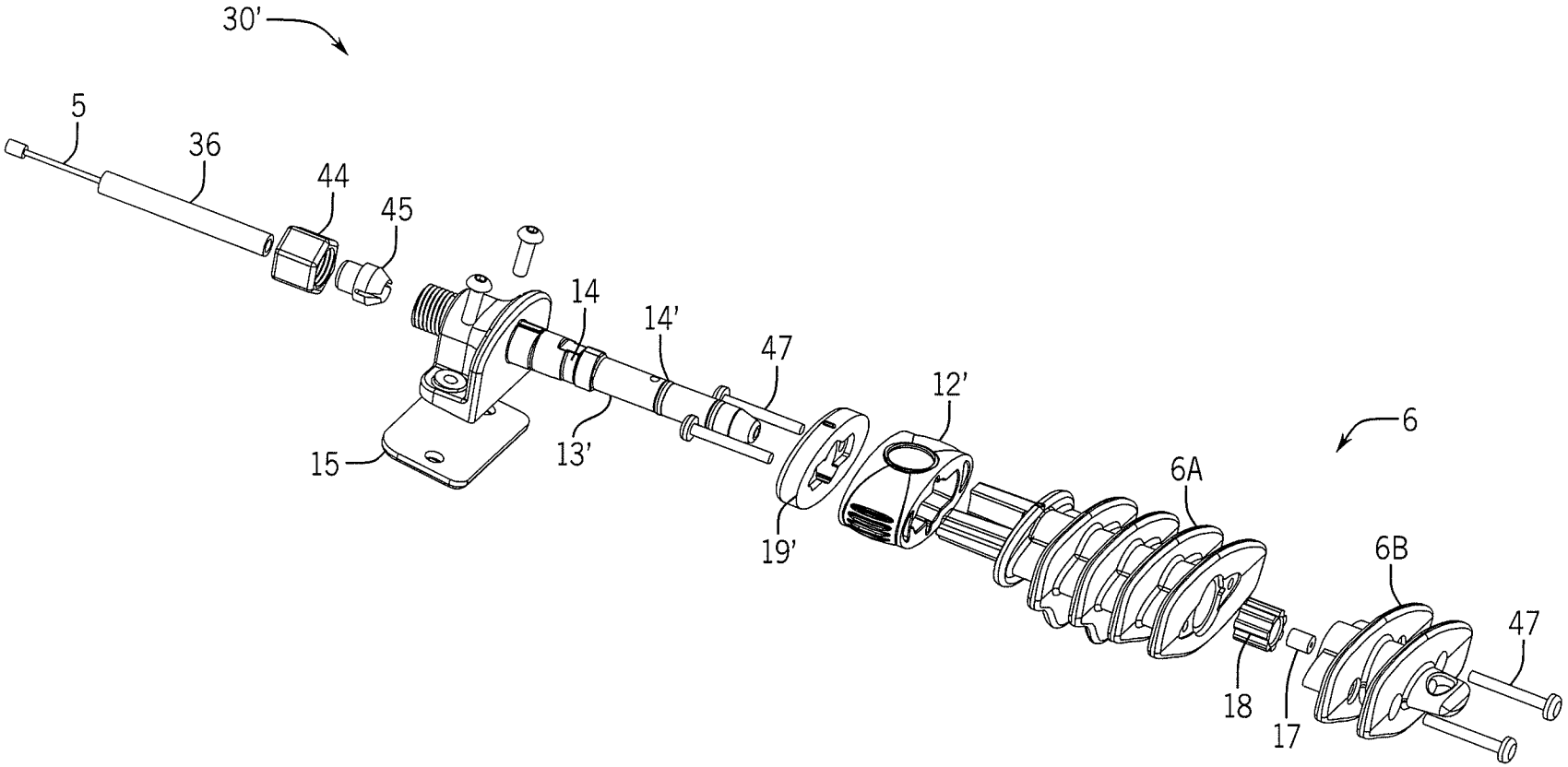
FIG. 19 is an exploded perspective view of a significant components of triggering device, showing the base plate, retaining flange, and base, which are designed to be fixed to a shoulder strap, as well as movable components, such as the trigger handle, safety lock, and cable.
Figure 20:
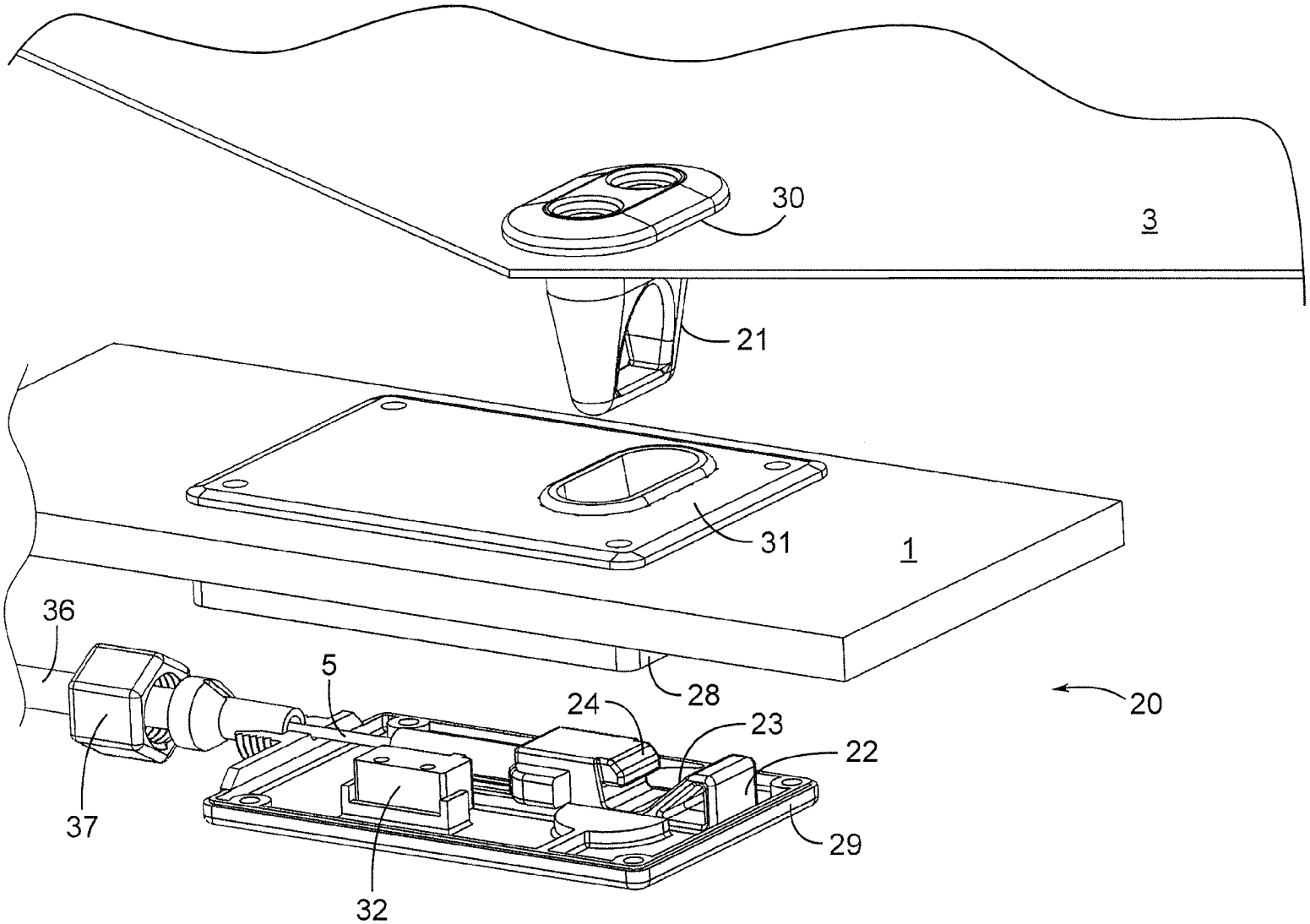
FIG. 20 is an exploded perspective view of the latch mechanism, similar to the view of FIG. 15, showing components of the latch mechanism in place within the latch case, with the cable of the triggering device attached to the latch.
Figure 21:
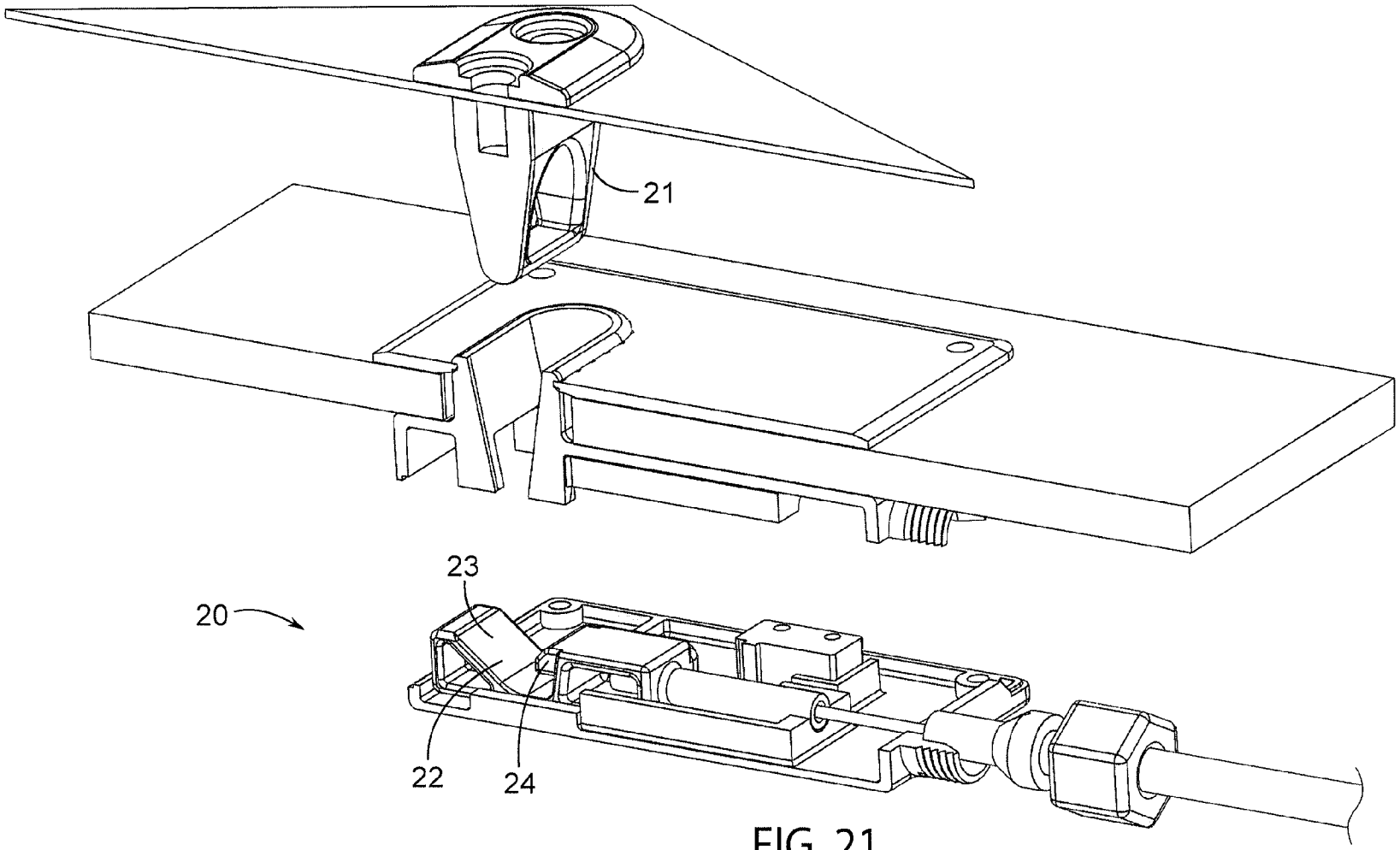
FIG. 21 is an exploded longitudinal cut-away perspective view of the latch mechanism of FIG. 20.
Figure 22:
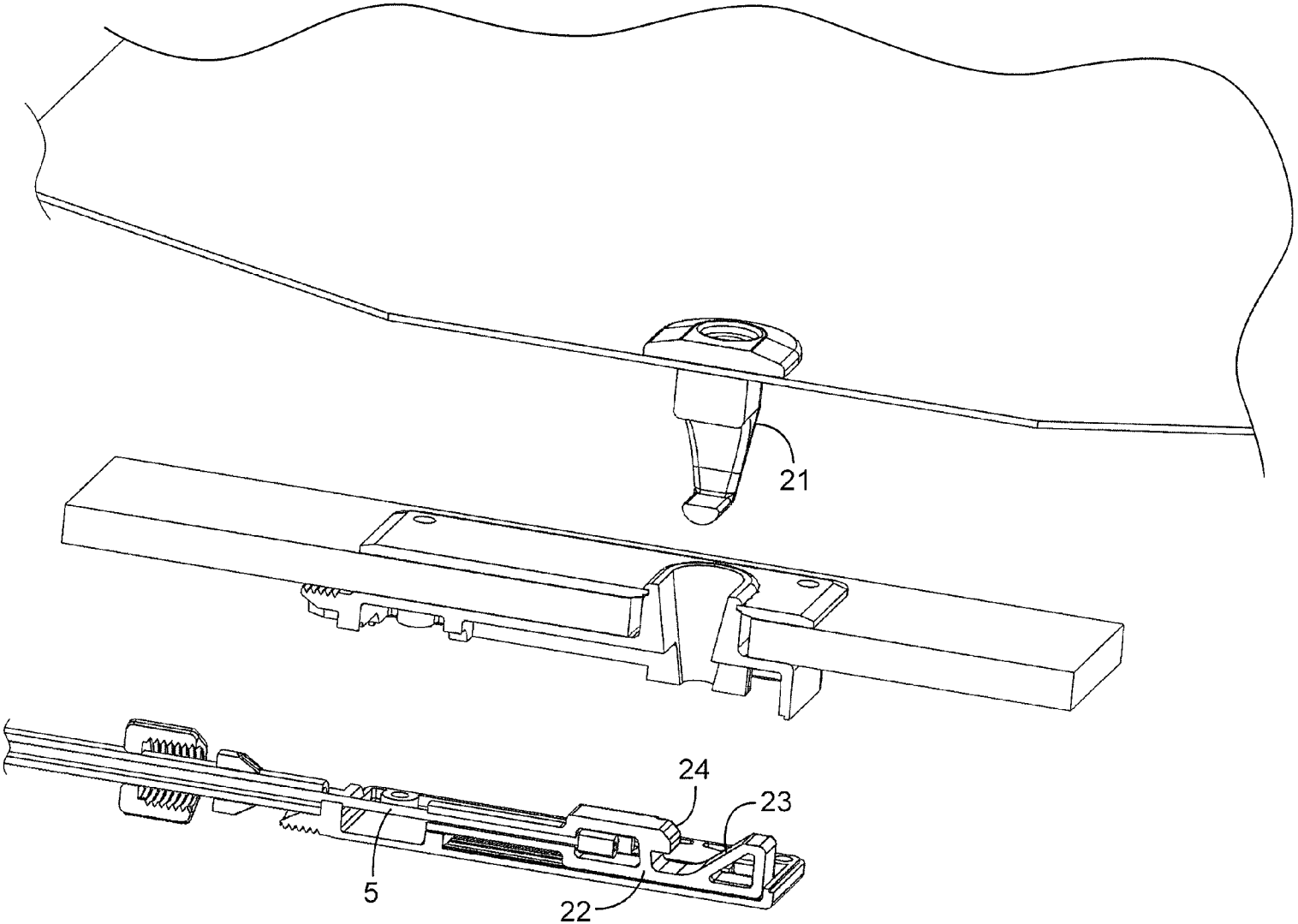
FIG. 22 is a further exploded longitudinal perspective view of the latch mechanism of FIG. 20, with the post of the latch mechanism cut-away through its center.
Figure 23:
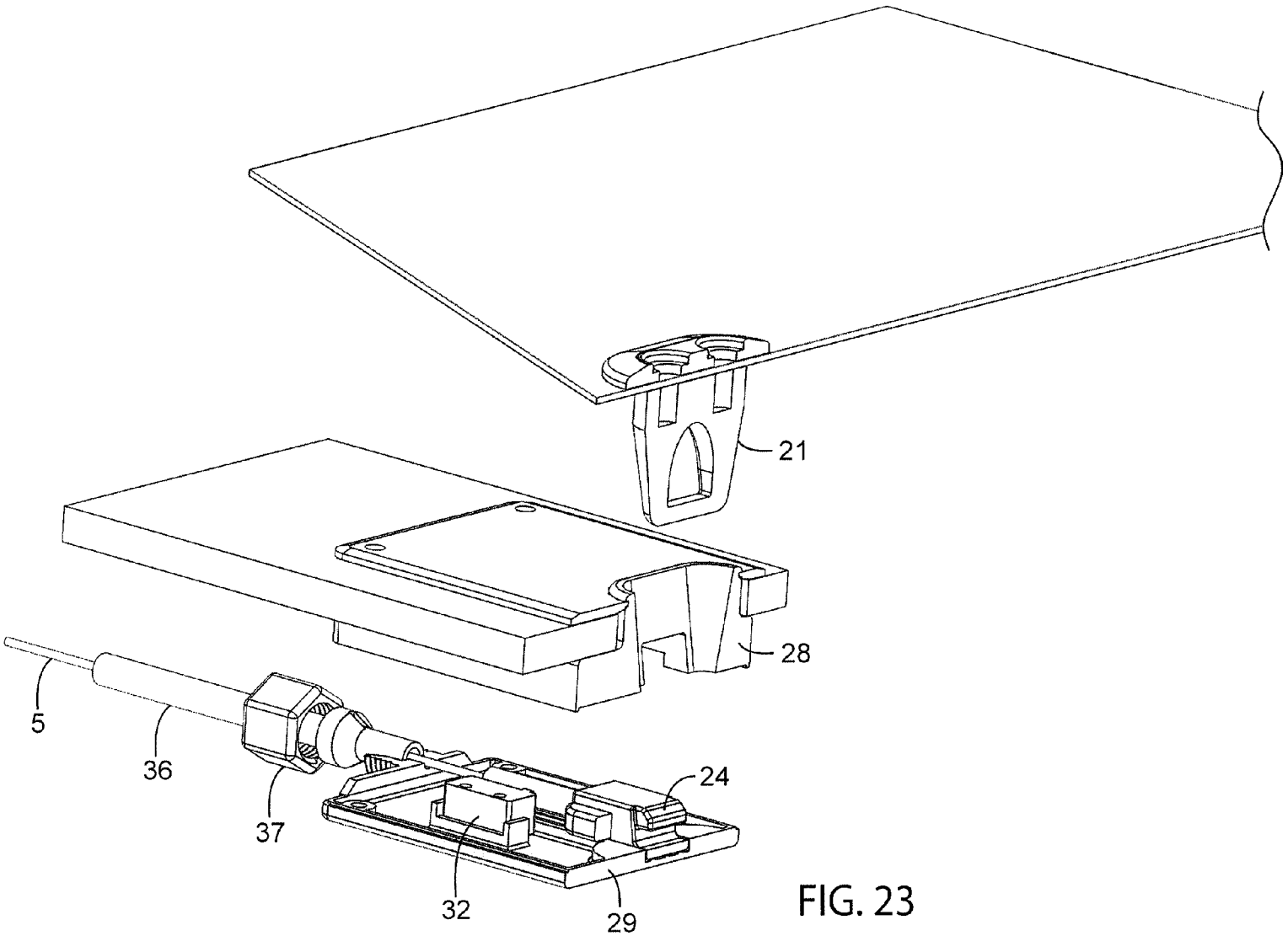
FIG. 23 is an exploded transverse cut-away perspective view of the latch mechanism of FIG. 20.

The foregoing description is also applicable to the second triggering device embodiment 30' illustrated in exploded perspective in FIG. 19, which includes handle 6, lock 12', lock retainer 19', and base 13'. The handle 4, as shown in FIGS. 14, 14A, 14B, is comprised of front and rear parts secured together. Likewise, the handle 6, shown in FIG. 19, is comprised of front and rear parts 6A, 6B which are secured together by means of fasteners 47.

After the minimum pull force is reached and the trigger handle 4, 6 has moved longitudinally beyond the base 13 or 13', the handle can pivot and move at an indirect angle in relation to the length of attached cable 5 to cover multiple pull angles, as the handle 4, 6 is then merely tethered to the shoulder strap 2 by means of the cable 5.

Next, the latch mechanism 20, if used in any particular embodiment, and, for an electrically powered inflation embodiment, the triggering of a power switch 32, that corresponds to the actuator that activates the airbag, are described with reference to relevant figures of the drawing.

Figure 15:
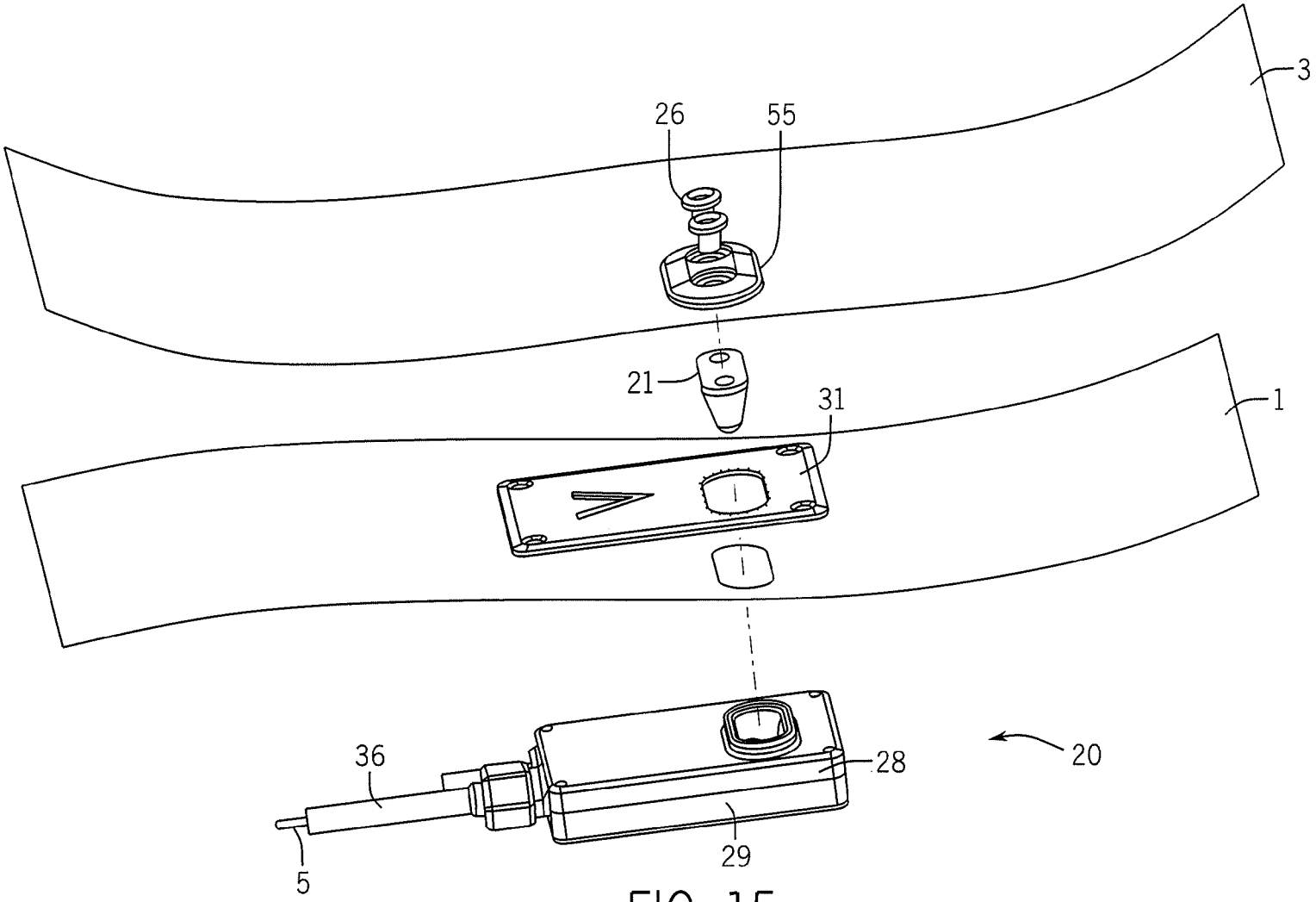
FIG. 15 is a schematic exploded view of a latch mechanism and associated portions of a pack and pack lid according to an embodiment of the invention.

When a completed pull of the handle 4 or 6 is accomplished, the locking post 21 of the latch mechanism 20 (see FIGS. 10 and 16, for example), fixed to the lid 3 at the top of the pack 1, by means of fasteners 26 extending through the post plate 55, and projecting downward from the lid, is pushed out of the latch 22. The ramp 23 of the latch (see FIG. 16, for example), as it is pulled by the cable 5, ensures enough force so that the post 21 can be pushed out even in the event it had become frozen in place). An electrical switch 32, fixed together with the latch 22 within the latch case comprised of the case top 28 and case bottom 29 (see FIGS. 15 and 16, for example), is incorporated within the latch mechanism 20 such that the post 21 must be released from the latch 22 before the electric motor can be activated (see FIGS. 15, 16, for example) by means of the plunger 34 engaging the power switch 32. FIG. 15 illustrates a surface plate 31, mounted to the fabric of the pack 1 by means of fasteners 26 connecting the plate 31 to the latch case 28, 29, with the switch 32 and latch 22 positioned within the thusly mounted case. The compression spring 35 biases the latch 22 to return to its initial position within the latch case after separation of the post 21 and the latch 22.

Figure 16C:
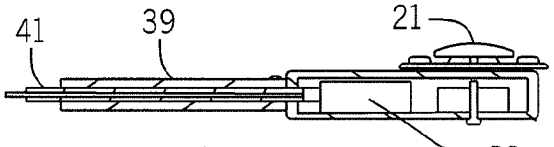
FIG. 16C is a cross-sectional view taken along line 16C-16C of FIG. 16A.
Figure 16B:
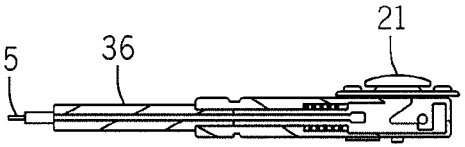
FIG. 16B is a cross-sectional view taken along line 16B-16B of FIG. 16A.
Figure 16A:
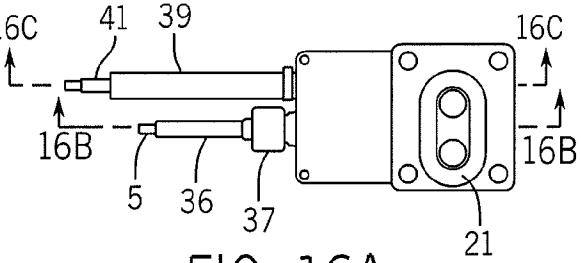
FIG. 16A is a top view of the latch case of FIGS. 15 and 16, assembled.
Figure 16:
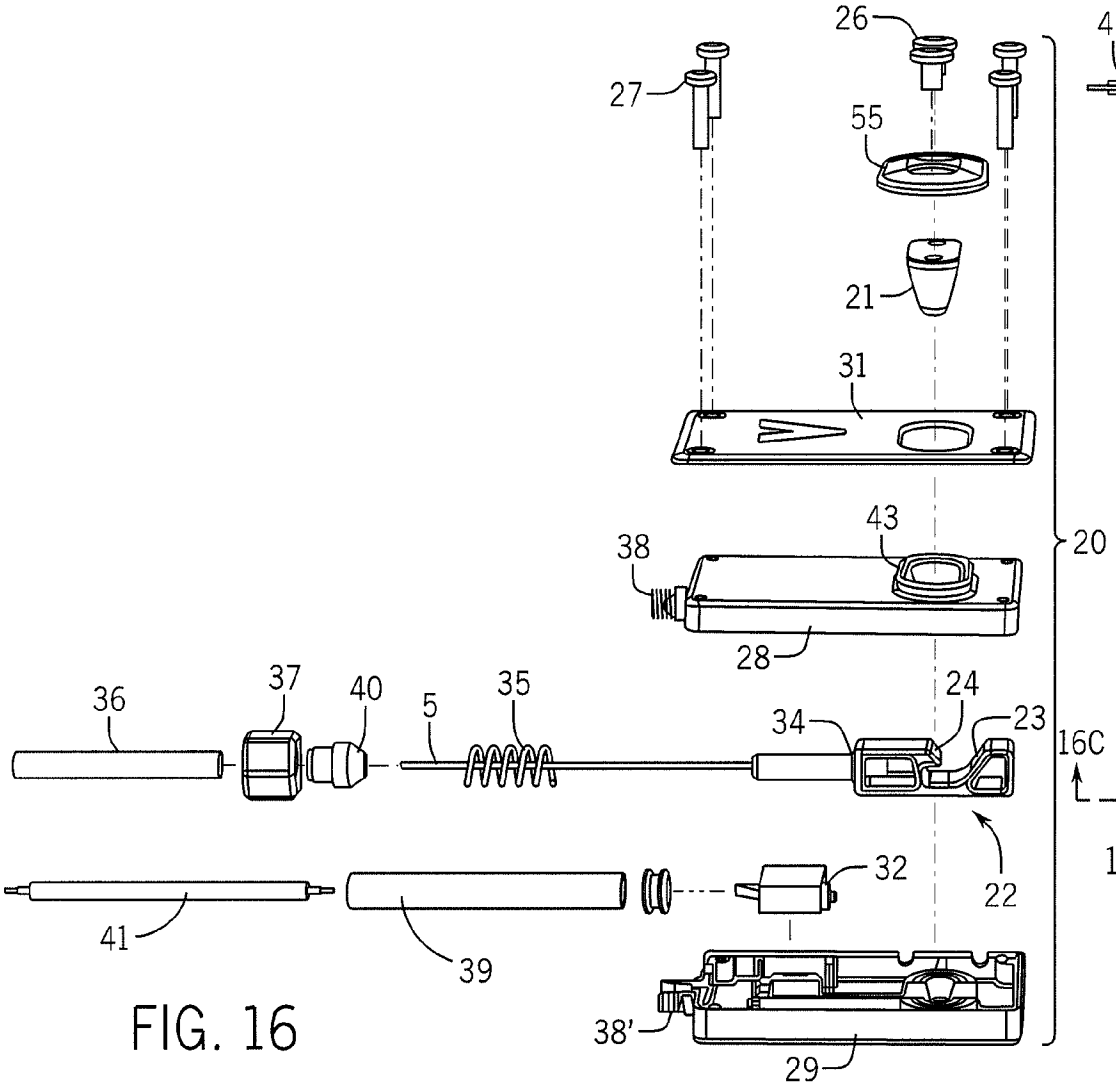
FIG. 16 is an exploded view of the latch mechanism, showing interior components of the latch case of the mechanism of FIG. 15.

The latch mechanism 20 of FIG. 16 also shows the cable housing 36, a compression nut 37 against which a collet 40 is positioned, the nut being engaged with the threaded sections 38, 38' that are formed on the respective top and bottom 28, 29 of the latch case. A protection tube 39 is provided for the electrical cable 41 to which the switch 32 is connected. The perspective and cross-sectional exploded views of FIGS. 20-23 show the latch mechanism 20 in greater detail.

After the post 21 is clear of the hook 24 of the latch 22 (that is, nothing holding the airbag compartment within the pack 1 closed, as shown in FIGS. 9-13), the motor is powered on to inflate the airbag 33, such as for a seven-second blower activation. That is, the motor cannot be activated until the post 21 has been released from the latch 22.

Once the latch 22 and post 21 of the latch mechanism 20 are released from each other, the lid 3 of the airbag compartment is completed unfettered to open (see FIGS. 9, 10), such that the inflation of the airbag 33 itself forces it from the compartment of the pack 1 to a deployed position. The post/latch combination 21, 22 is the single locking point of closure. The airbag 33 is stowed purely by being folded (such as by "origami" style or any non-restricting fold(s), but not by being rolled, for example), which allows the airbag to release, during inflation, in all directions (into a more than a full hemisphere), rather than "funneling" through a narrow door, for example.

Figure 24:
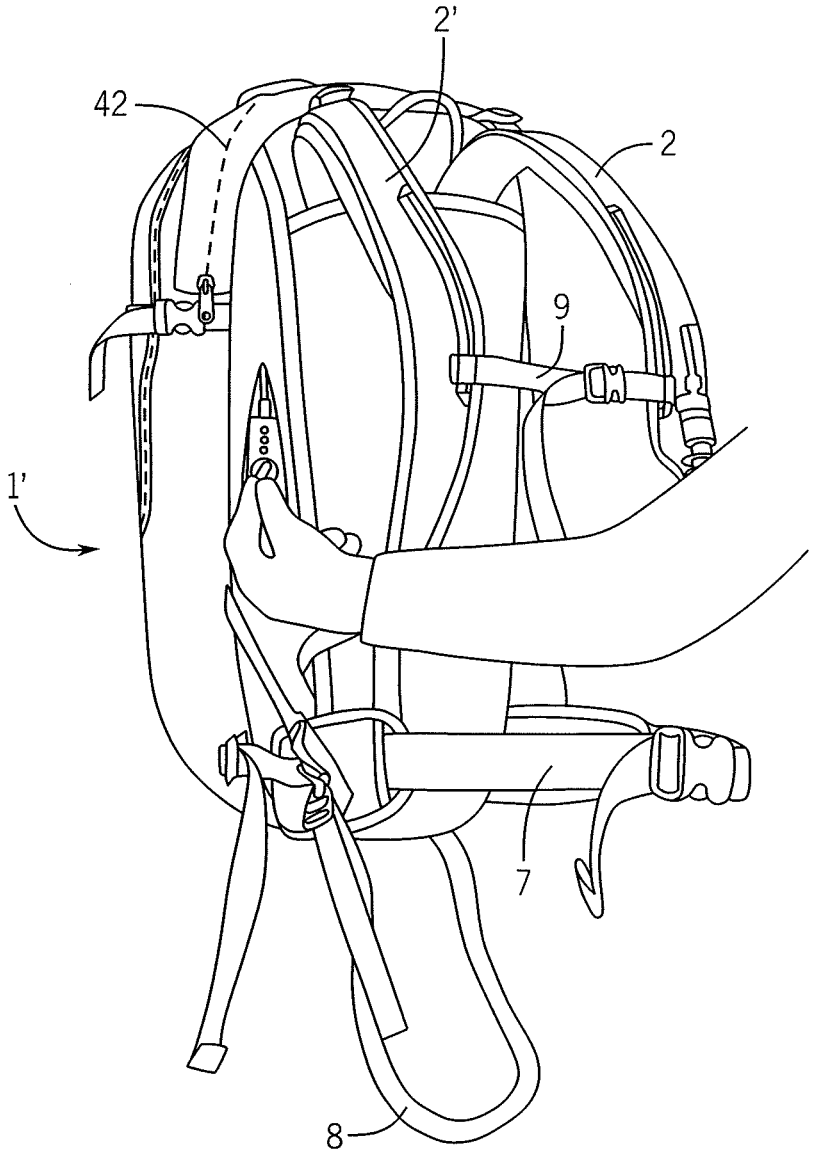
FIG. 24 is a view of a pack according to the invention having a readily burstable slide fastener, rather than a non-locking closure for the airbag.

The releasable latching embodiment described above is not the only closure that is encompassed by the invention, inasmuch as a non-locking closure for the airbag can be employed. For example, a separating sliding fastener, such as a readily burstable slide fastener, such as a burst zipper 42 shown in FIG. 24, can be employed. As known in the art, a burstable zipper has a number of teeth removed or omitted from one or more of the stringers of the zipper. If a burst zipper is employed, it can be positioned to extend across the top of the pack and, optionally, down the sides, as shown in FIG. 24, as the airbag is inflating, whereby the burst zipper automatically opens from the force generated by the inflating airbag, thereby allowing the airbag to emerge from the airbag compartment to the deployed position shown in FIGS. 2B and 25. The burst zipper can be re-zipped for further use, after the airbag is deflated and re-stowed in its compartment. With a readily burstable slide fastener, the cable system is used for activating the power switch 32, there being no need to open a latching mechanism as well.

Optionally, with the use of a burstable slide fastener, a Velcro® tab could be employed across the length of the fastener and it would be designed to release at the time of airbag inflation.

Figure 2A:
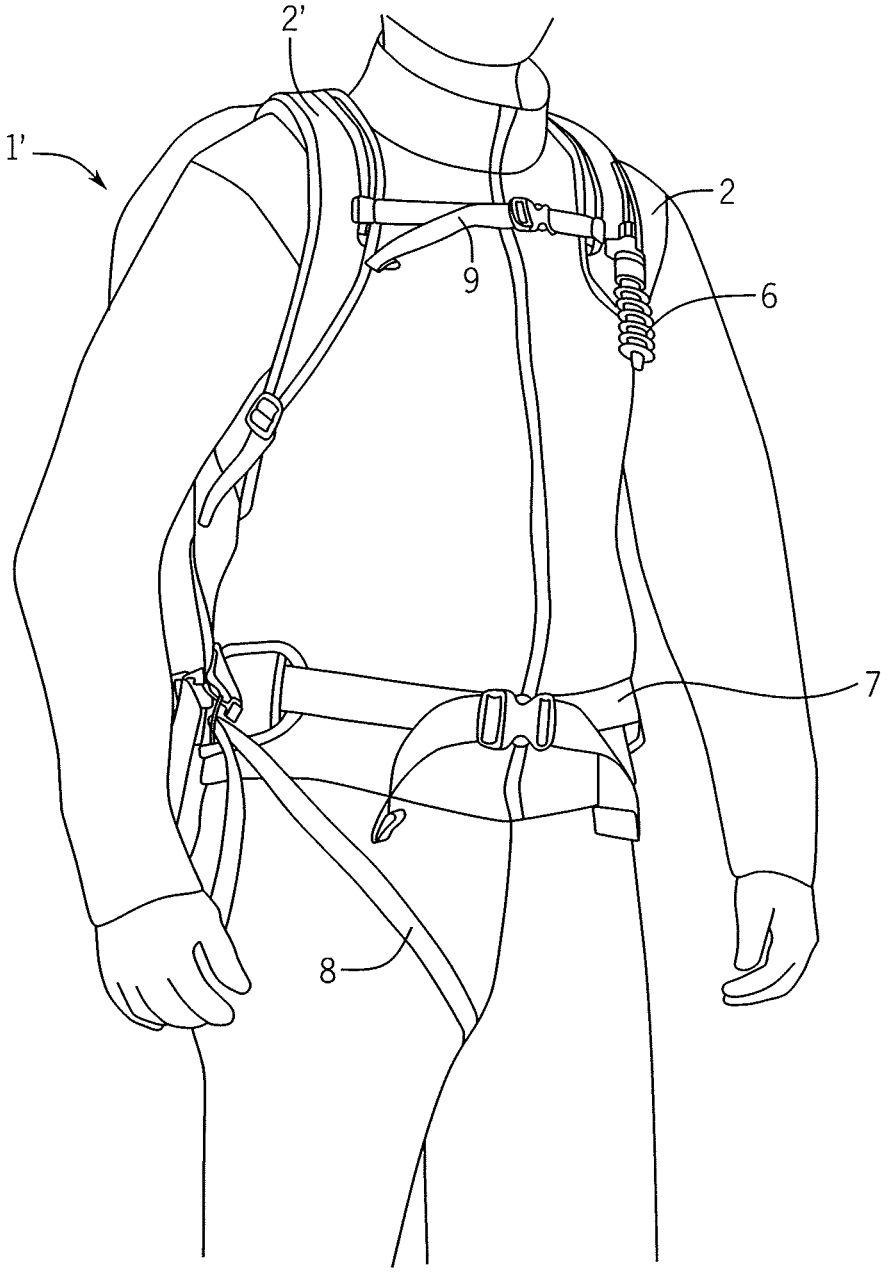
FIG. 2A is a view of the pack of FIG. 2 being worn, with the airbag being stowed, non-deployed, within a compartment of the pack.
Figure 2B:
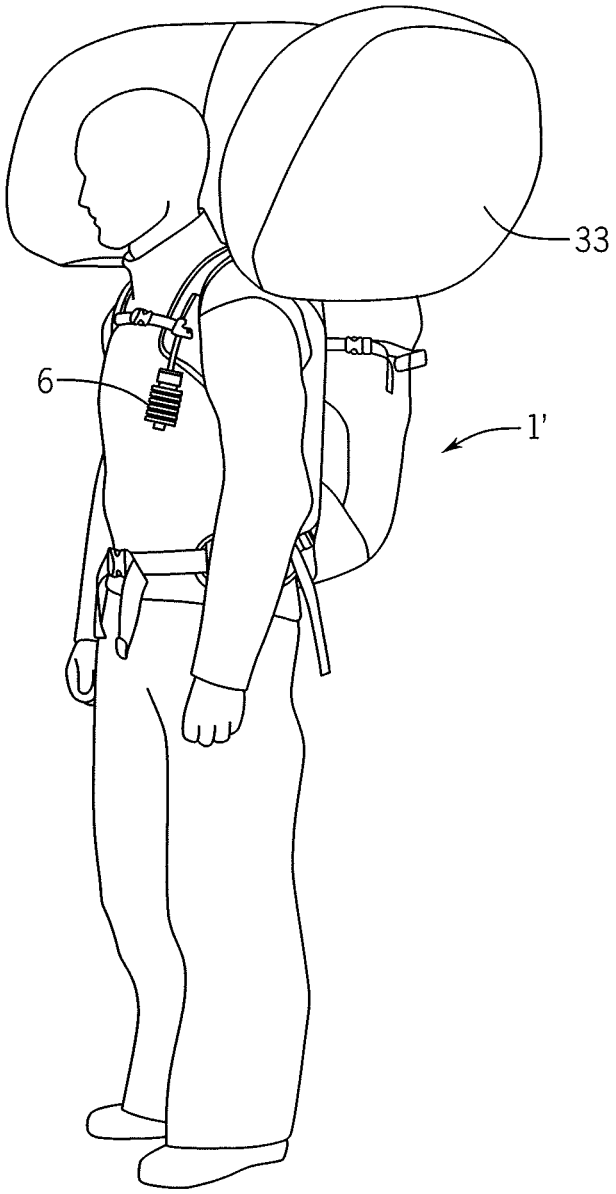
FIG. 2B is a view of the pack of FIG. 1 being worn, with the airbag being inflated in the deployed position.
Figure 13:
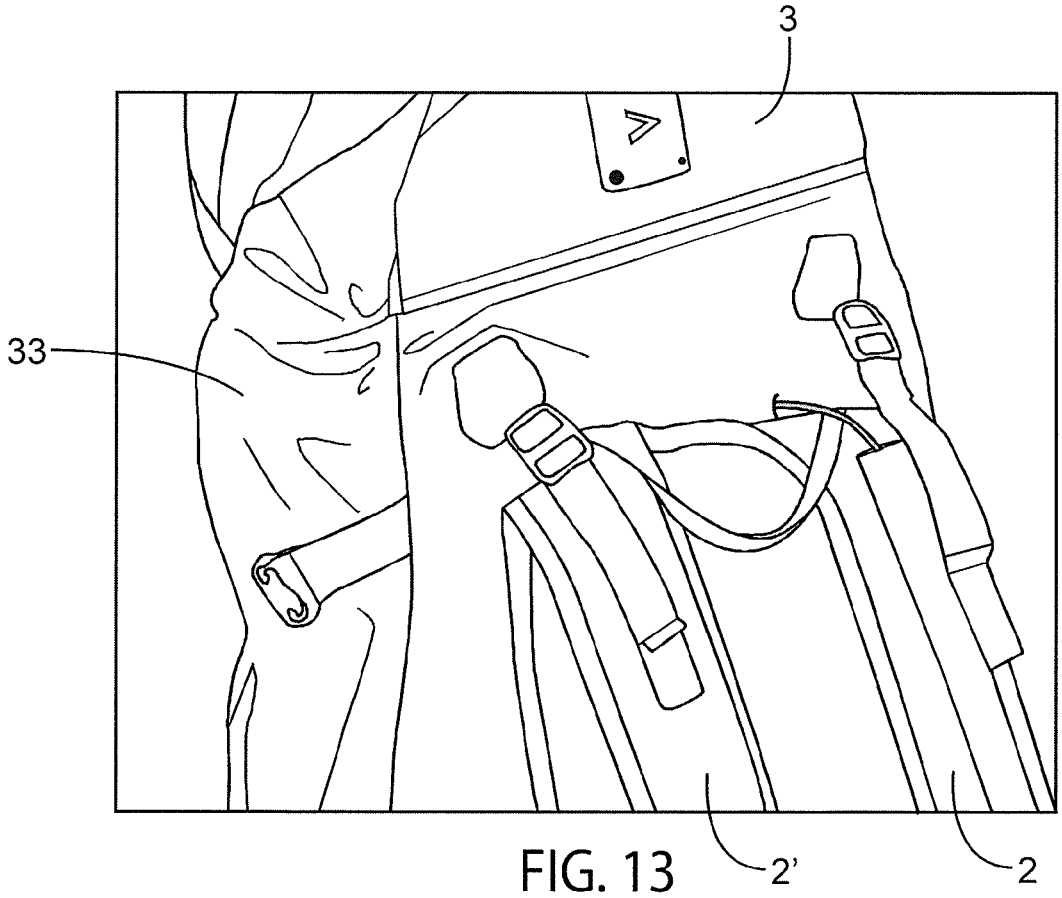
FIG. 13 is a partial view of the pack of FIG. 12, in perspective, showing the airbag having expanded further from its compartment.
Figure 25:
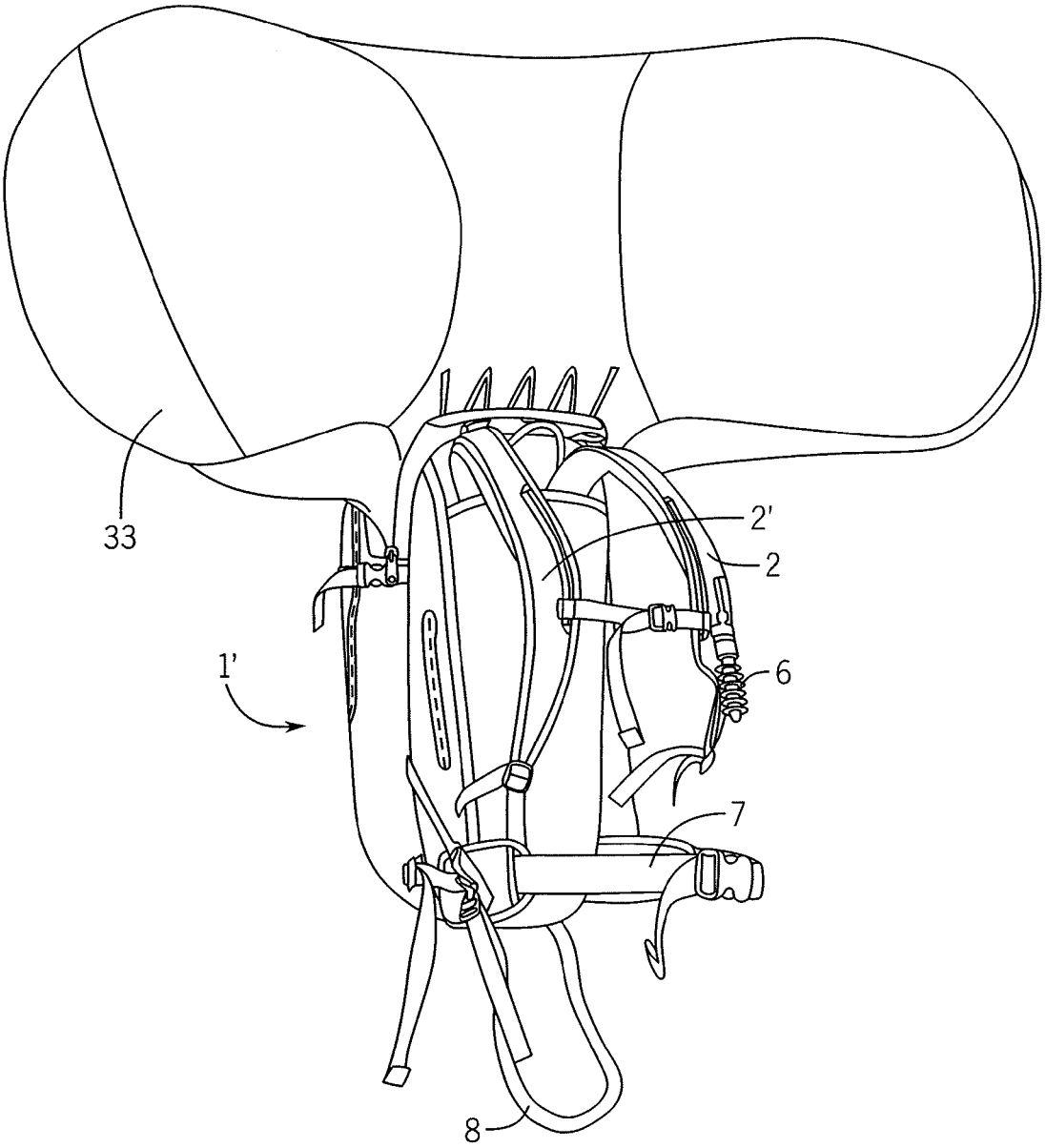
FIG. 25 is a view of the pack of FIG. 24, showing the airbag in a deployed and inflated position.

Any time after inflation of the airbag, such as shown in FIGS. 2B and 25, the trigger handle 4 or 6 can be pulled again to activate another seven-second blower cycle, or a cycle having an appropriate duration for a given application. In addition, upon inflation of the airbag and deployment during use, the blower can be automatically pulsed repeatedly to maintain inflation or a predetermined level of inflation.

After having deployed the airbag, the airbag can be returned to the non-deployed position within the pack (as shown in FIGS. 2, 2A, and 24), the trigger handle 4 or 6 must be physically pushed back into the closed position, that is, in the non-airbag-inflation-initiation position (see FIG. 3, showing the closed position, FIG. 4 showing the open position, that is, the airbag-inflation-initiation position) to re-enable the latching mechanism 20, if used, for stowing the airbag in its compartment. This ensures that the latch 22 cannot be accidentally re-fastened to the post 21. Alternatively, a detent recess can be provided within the switch/latch case 28, 29 that holds the latch 22 in an open position once it has been deployed. The locking post 21 being forcefully re-inserted into the socket 43 (see FIG. 16) engages with the ejector ramp 23 on the latch plunger 34 and snaps the latch 22 back past the detent recess. In this way, the ramp is used to the exact opposite effect as when it is used to eject the post initially. The trigger handle 4 or 6, in either event, is to be re-docked, if the cable length is set to do so, but it is not required.

Once the airbag is deflated, that is, purged of air, it can be easily packed back into the compartment of the pack (origami-style, for example, or otherwise using non-restricting folds) and quickly latched securely.

The cable mechanism, comprising the cable 5 extending between the trigger handle 4 or 6 and the latch mechanism 20 or burstable zipper 42, at the top of the pack, as well as associated parts, such as the housing 36, the compression nut 44 that engages with the threaded extension 46 attached to the flanged connector 16, or retaining flange, and the collet 45, is similar to the type of cable mechanism like that used in a bicycle brake cable system, for example.

The latch mechanism 20 (post in keyhole) is a solid structural component when closed (see FIGS. 7, 8, and 9) and is the only closure point on the compartment containing the airbag. The sides of the airbag compartment are folded in and are secured along with the top of the compartment at the latch point (see FIG. 11).

Features of the invention, relating to the foregoing description, include the following:

- An easily accessible exposed handle with a secure yet easily operated safety lock;
- Travel of the trigger handle over one or more detent recesses for additional warning of impending activation;
- Action at end of travel of the trigger handle to ensure a mechanical failsafe for proper sequence to (1) release the latch and (2) power on the motor;
- mechanical release also ensures release in wet, cold, icy conditions;
- Inability to re-latch without first repositioning the trigger handle;
- Clippable lanyard to provide additional activation surface in difficult situations;
- Airbag compartment folded so that it has a single latch point and, once unlatched, is completely free to open in any direction (except where it is attached to the pack).

In an alternative embodiment (not shown), the airbag compartment and the latch mechanism are different. The opening is on the upper back side of the pack top, that is, away from the wearer and in about the same orientation as in FIGS. 7 and 13 but facing the other way. It is secured by a hook-and-loop fastener, rather than the latch mechanism extending through holes in the fabric, as in the illustrated embodiment described above. In such a version, the cable runs over the top of the pack and allows the wearer to pull the hook-and-loop fastener open with the cable. It also features a switch for the motor that cannot be activated until the fastener has been opened.

A particular feature of the triggering handle 4 or 6 is that it is very easy for the user, that is, the person wearing the avalanche airbag and pack, to locate and grab the handle. To this end, the handle is always externally accessible, in contrast to systems whose components are stowed in a pouch, such as a zippered pouch, on a shoulder strap to prevent an accidental release that might be caused by being caught/snagged on something or an ill-timed or accidental manipulation. For systems in which the handle is kept in a pouch, the user can forget to unzip the handle and have it accessible when it is taken out. Also, they tend to move around within the pouch, so the handle is not in the same position all the time.

As mentioned above, the triggering device of the invention includes at least two features to avoid accidental triggering, while maintaining the triggering handle permanently exposed and easily accessible. One is that which is described above that includes the detent recess 14, particularly, over which the trigger handle 4 or 6 is engaged as the handle is pulled and a force of 50-150 N is required to completely pull the trigger handle for triggering activation.

Figure 17A:
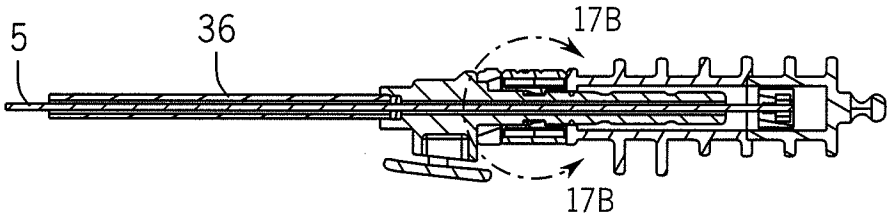
FIG. 17A is a cross-sectional view of the trigger handle of FIG. 17 taken along line 17A-17A of FIG. 17.
Figure 17B:
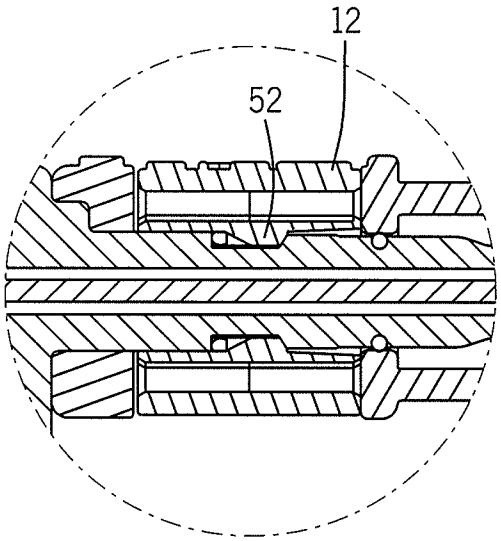
FIG. 17B is an enlargement of a portion of the trigger handle of FIG. 17, taken around the line 17B-17B of FIG. 17, showing the handle in the unlocked position.
Figure 18:
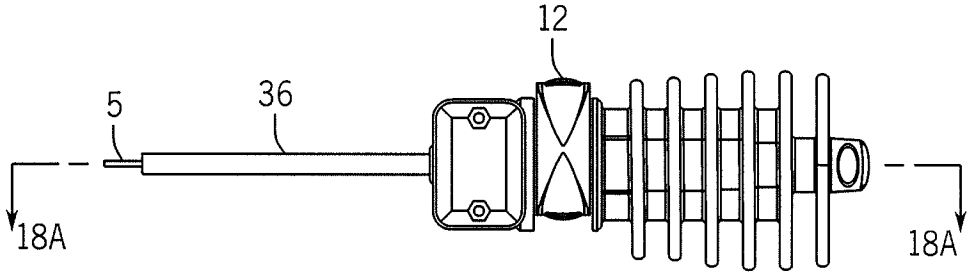
FIG. 18 is a top view of a trigger handle of the triggering device shown in FIG. 17, showing the slide lock thereof in a locked position, preventing the trigger handle to be pulled away from the base plate along the base of the triggering device.
Figure 18A:
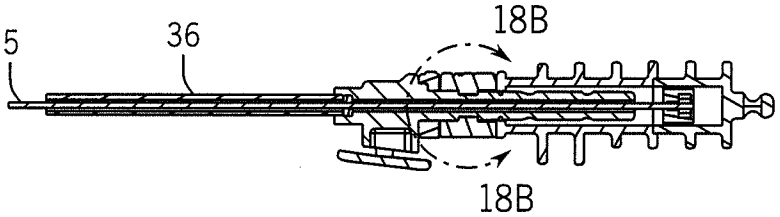
FIG. 18A is a cross-sectional view of the trigger handle of FIG. 18.
Figure 18B:
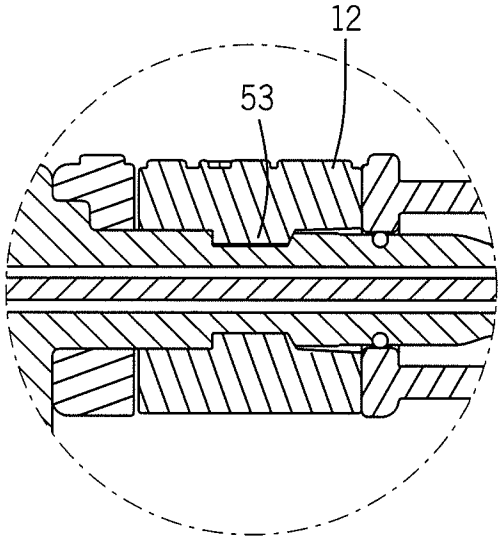
FIG. 18B is an enlargement of a portion of the trigger handle of FIG. 18, showing the handle in the locked position.

The second feature relates to a safety lock mechanism, such as that which includes a slidable lock 12 illustrated in FIGS. 17, 17A, 17B (unlocked) and FIGS. 18, 18A, 18B (locked). The slide lock 12 is designed to be moved between locked and unlocked positions with a single finger or thumb. In an emergency situation, the user might want to have the handle unlocked in a critical area. The motion that is required to unlock the slide lock safety triggering device is similar to that required for a gun safety lock. The locking mechanism is simply movable transversely, with a snap action, between the locked and unlocked positions.

The second feature can be realized differently, by a second embodiment of a pack 1' as illustrated in FIGS. 26, 26A, 26B, and 26C. The triggering device 30' has an alternative safety lock mechanism, particularly, one having a twistable lock 12', rather than a slide lock, that is, a lock that is rotatable about the base 13' that allows the user to flip the lock 180 degrees, i.e., with the remainder of the handle, around the base between locked and unlocked positions, the latter position allowing the handle 6 to be pulled longitudinally to initiate airbag inflation. That is, for accomplishing airbag inflation, the user moves the triggering device according to two manipulations. First, the safety lock 12' must be rotated from the locked position (shown in FIGS. 27 and 27A) to the unlocked position (shown in FIG. 26A). Second, the trigger handle 6 must be pulled in relation to the base 13' to the position shown in FIGS. 28, 28A, and 28B. FIG. 28C illustrates an enlarged detail of FIG. 28B, showing the trigger handle stopper 18 having reached a restricted position in relation to the trigger handle 6 such that the stopper 18, secured in place by the wire cable 5 end stop 17 to thereby release the post 21 from the latch 22, for embodiments having both a latch mechanism 20 (see FIG. 16, for example) and actuating the electrical switch 32, as explained above.

Figure 26C:
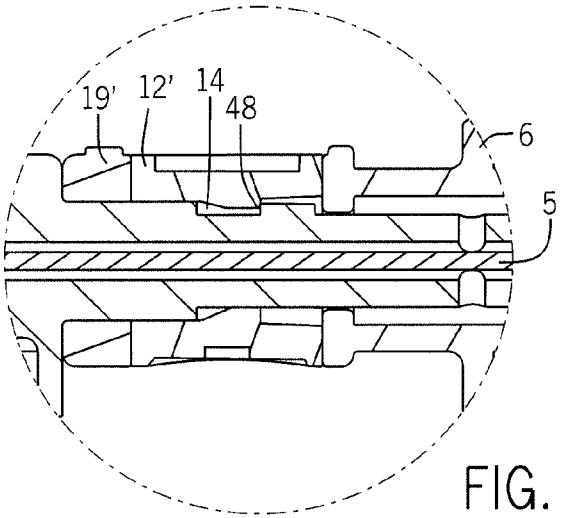
FIG. 26C is an enlarged detail of FIG. 26B.
Figure 28:
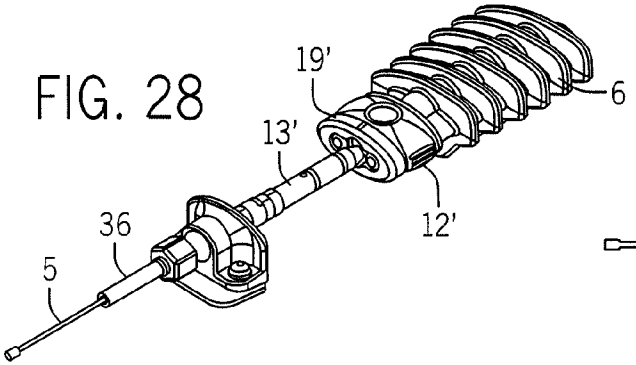
FIG. 28 is a perspective view of the handle, base, cable, and rotatable safety lock components of the triggering device shown in FIG. 19, assembled in a "pulled" position of the trigger handle, that is, in the airbag-inflation-initiation position.

In the unlocked position of the twist lock 12', whereby the handle 6 had been twisted 180° around the base 13', a lower profile wedge 48 projecting from the interior of the handle 6, shown in FIG. 26C, provides a certain level of resistance, such as within the range of 50-150 N, for disengagement of the lock from the detent recess 14 during the pulling of the handle 6 to the pulled position shown in FIG. 28. An indication on the handle 6, in the form of a green circle 51, alerts the user to the handle being in the unlocked position. Other forms and shapes can be used for the same purpose.

Figure 27B:
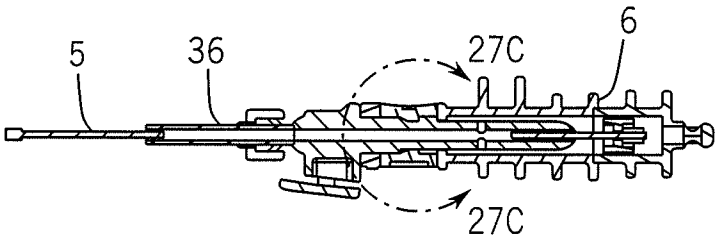
FIG. 27B is a longitudinal cross-sectional view taken along lines A-A of FIG. 27A.
Figure 27A:
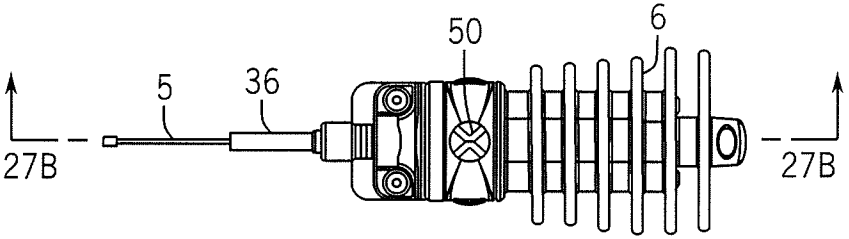
FIG. 27A is a top view of the components of FIG. 27, with the rotatable safety lock in the locked position.
Figure 27:
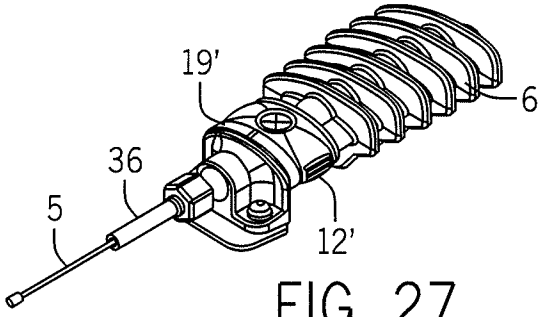
FIG. 27 is a perspective view of the handle, base, cable, and rotatable safety lock components of the triggering device shown in FIG. 19, assembled in the locked position of the lock.
Figure 27C:
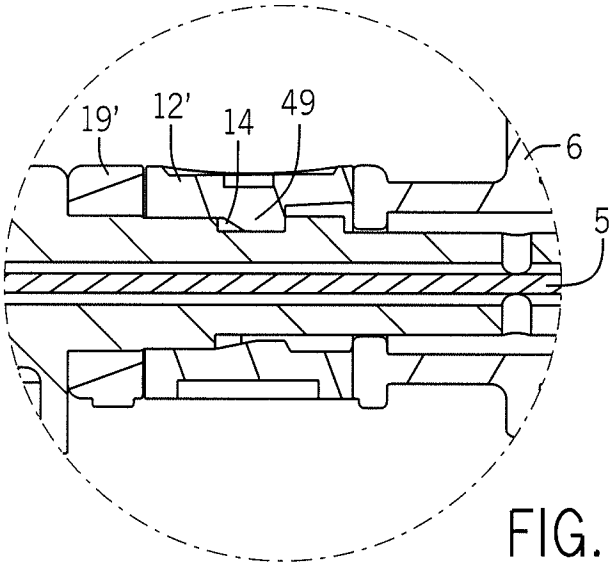
FIG. 27C is an enlarged detail of FIG. 27B.
Figure 28B:
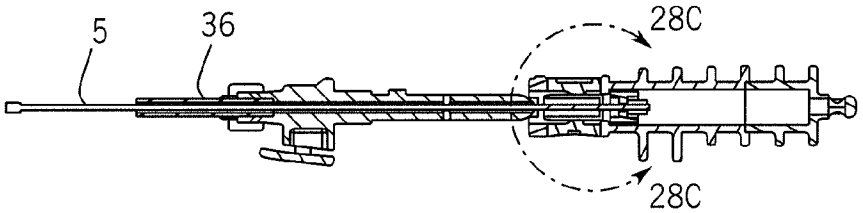
FIG. 28B is a longitudinal cross-sectional view taken along lines A-A of FIG. 28A.
Figure 28A:
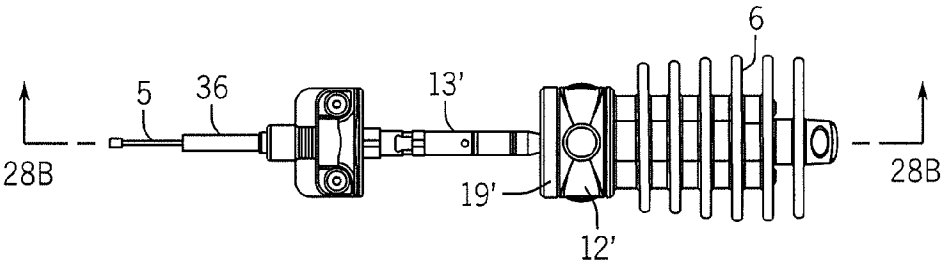
FIG. 28A is a top view of the components of FIG. 28.
Figure 28C:
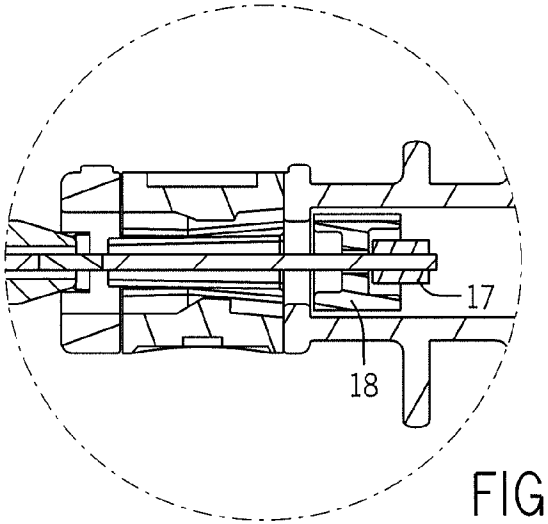
FIG. 28C is an enlarged detail of FIG. 28B.

A red "X" 50, or other indication, is shown in FIGS. 27 and 27B as an indication that the handle 6 is in the locked position, after the handle had been rotated from the unlocked position. As shown in FIG. 27C, the higher profile wedge 49 of the handle 6 provides a positive lock against longitudinal displacement of the handle 6 in the locked position. While the detent recess 14 is shown on the base 13' (or base 13, for the slide lock embodiment), the detent recess could be located on the handle and a complementary wedge or projection could be formed on the base.

The aforementioned locked and unlocked positions of the "twist" trigger handle 6 are also indicated in FIG. 2, with an "X" and "O", respectively, for the two positions of the safety lock 12'. In this example, the indication of the state of the handle (locked or unlocked) is visible, which means this indication is not oriented toward the user, but outwardly.

The triggering device 30, 30' can also comprise means for maintaining the trigger lock 12, 12' in an expected position, locked/unlocked. These means may be clips, plastic deformation, tightening, for example.

For manufacturing airbag rescue systems and triggering devices in particular, the use of various materials are within the scope of the invention and various manufacturing processes are within the scope of the invention, such as injection molding. Various components of the triggering device, such as the handle and the lock, as well as the base, for example, can be made of any of various synthetic polymers such as particular thermoplastics, including nylon and, more particularly, polyoxymethylene (POM), for example, the latter being self-lubricating and offers favorable characteristics for use in cold and wet conditions, has a low coefficient of friction, low water absorption, excellent dimensional stability, and high tensile strength, for example. In this regard, variations of components are embraced by the invention, such as making the base plate 15 and retaining flange 16 as one piece. Other components, such as cables, screws, nuts, etc. can be made of stainless steel or other materials that have characteristics that perform well in outdoor environments, particularly in wet and cold environments.

The invention is not limited to the particular embodiments shown and described, but extends to all embodiments covered by the following claims.

Lastly, at least because the invention is disclosed herein in a manner that enables one to make and use it by virtue of the disclosure of particular exemplary embodiments of the invention, the invention can be practiced in the absence of any additional element or additional structure that is not specifically disclosed herein.

The invention claimed is:

1. An airbag rescue system for a user, the system comprising:

an inflatable airbag designed to be in a non-deployed position or a deployed and inflated position;

a gas or air movement device comprising at least one of the following: a source of compressed gas or air or an electrically powered air mover that includes a bladed rotor;

a supporting apparatus comprising a harness or a backpack designed to support the inflatable airbag and the gas or air movement device on the user in a ready position of the airbag rescue system;

a base plate fixed to the supporting apparatus;

a triggering device designed to be manipulated by the user according to at least first and second manipulations to initiate inflation of the inflatable airbag, the triggering device comprising:

a base fixed in relation to the base plate, the base including a blocking part;

a trigger handle designed for movement by the user, in relation to the base, from a non-airbag-inflation-initiation position to an airbag-inflation-initiation position;

a safety lock designed for movement by the user, in relation to the base, from a locked position and an unlocked position;

said movement of the safety lock comprising the first manipulation of the triggering device, and said movement of the trigger handle comprising the second manipulation of the triggering device; and in the locked position of the safety lock, the safety lock engages the blocking part and blocks the movement of the trigger handle, and, in the unlocked position of the safety lock, the safety lock is not blocked by the blocking part of the base.

2. An airbag rescue system according to claim 1, wherein:

the supporting apparatus comprises a shoulder strap; and the base plate is fixed in relation to the shoulder strap.

3. An airbag rescue system according to claim 1, wherein:

the safety lock is mounted over the base and the movement of the safety lock is transverse in relation to the base.

4. An airbag rescue system according to claim 1, wherein:

the safety lock is mounted over the base and the movement of the safety lock is rotational in relation to the base.

5. An airbag rescue system according to claim 1, wherein:

the triggering device further comprises a cable extending between the trigger handle and the supporting apparatus.

6. An airbag rescue system according to claim 5, wherein:

the base is tubular and extends from the base plate in a direction to the trigger handle, the trigger handle slidably mounted on the tubular base; and the cable of the triggering device is fixed in relation to the trigger handle, extends through the tubular base and the cable and a cable housing extend between the base plate and the supporting apparatus.

7. An airbag rescue system according to claim 6, further comprising:

an electric power switch designed to activate the electrically powered air mover; and the cable is connected to the electric power switch.

8. An airbag rescue system according to claim 1, wherein:

in the non-airbag-inflation-initiation position of the triggering device in the ready position of the airbag rescue system, the trigger handle is suspended from the base plate, the airbag rescue system having no pocket or cover for the trigger handle.

9. An airbag rescue system according to claim 5, wherein:

the supporting apparatus comprises a closeable airbag compartment containing the airbag in the non-deployed position; and the airbag compartment includes an opening system to allow the airbag to emerge from an opening in the compartment upon the initiation of the inflation of the airbag by the triggering device.

10. An airbag rescue system according to claim 9, wherein:

the opening system comprises a readily burstable slide fastener that releasably closes the opening of the airbag compartment and is designed to open upon inflation of the airbag; and the cable is operably connected to the air movement device to activate either the source of compress gas or air or the electrically powered air mover upon initiation of the inflation of the airbag by the triggering device.

11. An airbag rescue system according to claim 10, wherein:

the air movement device is an electrically powered air mover comprising a power switch; and the cable is operably connected to the power switch to activate the electrically powered air mover upon initiation of the inflation of the airbag by the triggering device.

12. An airbag rescue system according to claim 9, wherein:

the opening system includes a lid and a latch mechanism to releasably secure the lid over the opening;

the latch mechanism comprises:

a latch fixed to one of a surface of the compartment or a surface of the lid; and a post fixed to a second of the surface of the compartment or the surface of the lid; and the cable is operably connected to the air movement device to activate either the source of compress air or the electrically powered air mover.

13. An airbag rescue system for a user, the system comprising:

an inflatable airbag designed to be in a non-deployed position or a deployed and inflated position;

a gas or air movement device comprising at least one of the following: a source of compressed gas or air or an electrically powered air mover that includes a bladed rotor;

a supporting apparatus comprising a harness or a backpack designed to support the inflatable airbag and the gas or air movement device on the user in a ready position of the airbag rescue system, the supporting apparatus comprising first and second shoulder straps;

a base plate fixed in relation to the first shoulder strap;

a triggering device designed to be manipulated by the user to initiate inflation of the inflatable airbag, the triggering device comprising:

a base fixed in relation to the base plate;

a trigger handle designed for movement by the user, in relation to the base, from a non-airbag-inflation-initiation position to an airbag-inflation-initiation position;

a supplemental triggering mechanism comprising a lanyard having a first end fixed in relation to the trigger handle and a second end having a releasable clip;

the lanyard having a length designed to allow the releasable clip to removably fasten the lanyard to a second location spaced apart from the trigger handle.

14. An airbag rescue system according to claim 13, wherein:

the second location is the second shoulder strap, and wherein the lanyard extends between the first and second shoulder straps.

15. An airbag rescue system according to claim 14, wherein:

the base plate is removably fixed in relation to the first shoulder strap to allow relocating the base plate to be fixed in relation to the second shoulder strap.

16. An airbag rescue system for a user, the system comprising:

an inflatable airbag designed to be in a non-deployed position or a deployed and inflated position;

a gas or air movement device comprising at least one of the following: a source of compressed gas or air or an electrically powered air mover that includes a bladed rotor;

a supporting apparatus comprising a harness or a backpack designed to support the inflatable airbag and the gas or air movement device on the user in a ready position of the airbag rescue system, the supporting apparatus comprising at least one shoulder strap;

a base plate fixed in relation to the shoulder strap;

a triggering device designed to be manipulated by the user to initiate inflation of the inflatable airbag, the triggering device comprising:

a base fixed in relation to the base plate and having a length extending from the base plate;

a trigger handle slidably mounted along the length of the base for movement by the user from a non-airbag-inflation-initiation position to an airbag-inflation-initiation position;

at least one detent recess fixed at a predetermined position along the length of the base to engage a portion of the trigger handle during said movement of the trigger handle but before the trigger handle reaches the airbag-inflation-initiation position to thereby provide physical feedback to the user of an impending triggering of the inflation of the airbag.

17. An airbag rescue system according to claim 16, wherein:

the at least one detent recess and the portion of the trigger handle are made of materials and are arranged in relation to each other to require a force between 50 and 150 Newtons to be applied to the trigger handle to move the portion of the trigger handle beyond the detent recess to enable the trigger handle to the airbag-inflation-initiation position.

18. An airbag rescue system according to claim 17, wherein:

at least one of the detent recess or the portion of the trigger handle comprises an elastically deformable material.

19. An airbag rescue system according to claim 17, wherein:

the at least one detent comprises first and second detent recesses spaced apart from each other.

* * * * *